US005702279A

United States Patent [19]

Brown

[11] Patent Number: 5,702,279

[45] Date of Patent: Dec. 30, 1997

[54] INFLATABLE SWIMMER'S SAFETY BELT, LIFE PRESERVER/LIFE VEST

[76] Inventor: Dennis Brown, 1358 Hooper Ave., Ste. 240, Toms River, N.J. 08753

[21] Appl. No.: 699,723

[22] Filed: Sep. 3, 1996

[51] Int. Cl.[6] ..... B63C 9/16

[52] U.S. Cl. ..... 441/108; 441/113

[58] Field of Search ..... 441/41, 94, 106, 441/107, 108, 113, 114–117, 119, 120, 122, 123

[56] References Cited

U.S. PATENT DOCUMENTS

| | | | |
|---|---|---|---|
| 4,626,221 | 12/1986 | Rocco | 441/108 |
| 5,022,879 | 6/1991 | DeForte | 441/108 |
| 5,178,569 | 1/1993 | Wang | 441/106 |
| 5,368,512 | 11/1994 | Brown | 441/113 |

*Primary Examiner*—Jesus D. Sotelo
*Attorney, Agent, or Firm*—Charles L Brodsky

[57] ABSTRACT

A first belt of the invention—substantially hollow and worn about the waist—is able to be filled with a compressed gas from a cartridge coupled with it so as to unfold and expand outwardly under action of the compressed gas which fills it. A second belt of the invention—of conventional construction and also worn about the waist—underlies the first belt and is tethered to it. When the first belt is filled with the compressed gas, its length increases to form a tube riding under the armpits and holding a wearer vertically in the water as a life preserver, allowing the wearer to be able to swim about. Couplings are provided on the first belt for maintaining its configuration while allowing the tube to be slid over the arms to the shoulders and neck area in continuing to hold the wearer vertically, but as a life vest, keeping the head of the wearer out of the water. The tether prevents the tube from coming loose and floating away.

19 Claims, 29 Drawing Sheets

INFLATABLE SWIMMER'S SAFETY BELT, LIFE PRESERVER/LIFE VEST

FIELD OF THE INVENTION

This invention relates to personal flotation devices and, more particularly, to an inflatable swimmer's safety belt which can be effectively used in both a fresh-water and salt-water environment.

BACKGROUND OF THE INVENTION

As is well known and understood, personal flotation devices (PFDs) come in a variety of shapes, colors and materials. Typically required for recreation boat use, how many, and what type PFDs are required depends on the number of people on board, the size of the boat, and the kind of boating one does.

As is also known, United States Coast Guard Regulations specify answers to these types of questions. For example, if the boat employed is 16 feet or longer, Regulations require at least one of the following PFDs for each person on board; a) an Off-shore Life Jacket (Type I PFD), which is best for open, rough or remote water, or where a rescue may be slow in coming, but which is quite bulky; b) a Near-Shore Buoyant Vest (Type II PFD), which is good for calm, inland water, or where there is a good chance of fast rescue, but which is not intended for long hours in rough water, and will not turn all unconscious wearers face-up in the water; c) a Flotation Aid(Type III PFD), which also is good for calm, inland water, or where there is a good chance of fast rescue, but which is not generally intended for rough water usage; d) a Throwable Device (Type IV PFD), which is intended for calm, inland water where help is always nearby, but which is not intended for unconscious persons, nor for non-swimmers or children, nor for many hours of usage in rough water; and e) a Special Use Device (TYPE V PFD), which is intended only for unusual conditions, that require less active use and care.

While such devices are typically employed by those on boats —fishing, canoeing and kayaking—a very large market exists for those who do not go near the water at all, because they cannot swim, but who could benefit through the use of some type of personal flotation device.

My U.S. Pat. No. 5,180,321, issued Jan. 19, 1993 and entitled "swimmer's Safety Belt" describes a substantially hollow belt, worn about the waist, and able to assume the shape of a life preserver in use, while allowing the swimmer to swim to safety after falling into the water, using whatever swim strokes are convenient. As is there set forth, a cartridge is employed, to fill the belt with compressed gas in allowing the life preserver so formed to ride up to the wearer's arm level.

My U.S. Pat. No. 5,368,512, issued Nov. 29, 1994, and entitled "Inflatable Swimmer's Safety Belt", on the other hand, went further in employing a pair of belts, tethered together, to restrict the life preserver arrangement to rise up to the wearer's arm level, to hold the wearer vertically in the water—thereby obviating the possibility of the life preserver moving over the shoulders and head of the wearer and somehow possibly coming free. With this feature, a life preserver tube was formed of the first belt, tied to the second belt at a length which prevented the tube from slipping over the shoulders and head of the wearer, even while still allowing him or her to be able to swim about.

While the safety belts of these two patents performed as described and exhibited quite adequate safety features, the belt of the present invention will be seen to go even further.

SUMMARY OF THE INVENTION

In particular, and as will be seen, the safety belt of this invention can be arranged either as a life preserver, to allow the wearer to continue to be able to swim about, or can be converted in a very simple manner to a life vest, to hold unconscious wearers face-up in the water, for non-swimmers or children, and for those who can swim but tire, while trying to reach shore, or to reach rescue boats.

As will be described, a pair of belts continue to be used, with a first belt—substantially hollow and worn about the waist —able to be filled with a compressed gas from a cartridge coupled with it, and actuated by a pin whose placement is controlled by a pulling on an included lanyard. Such first belt, like the ones described in my prior patents, is secured in overlapping relationship so as to unfold and expand outwardly under action of the compressed gas which fills it. A second belt is further provided, like before, of conventional construction to be worn about the waist, underlying the first belt, yet being tethered to it. However, and as described, the first belt is also provided, in a preferred embodiment, with a snap hook-and-ring coupling at opposite ends of a jacket enclosing the first belt, to maintain the configuration of the life preserver tube formed by inflating the first belt, even when the clasp which closed the first belt is thereafter opened. In accordance with the invention, such first belt—once its clasp is opened—is coupled about the second belt, and thereafter connected to it by a then closing of the clasp of the first belt, in holding the two belts together. In the preferred embodiment shown, the second belt, together with the tether, restricts the upward movement of the tube to the neck area of the wearer, forcing his or her head back out of the water, and providing a viable safety vest even to an unconscious wearer.

According to a further feature of the invention, the first belt is enclosed in a jacket in an overlapping Z-fold of rectangular configuration when not deployed, in providing a very comfortable, lightweight, smooth flotation device, which can be worn as a belt, in or out of the water, for hours on end. When needed, the included lanyard can be pulled, and the first belt then automatically inflates to rise up under the armpit for maximum stability.

BRIEF DESCRIPTION OF THE DRAWINGS

These and other features of the invention will be more clearly understood from a consideration of the following description, taken in connection with the accompanying drawings, in which.

DETAILED DESCRIPTION OF THE DRAWINGS

Figure 1:
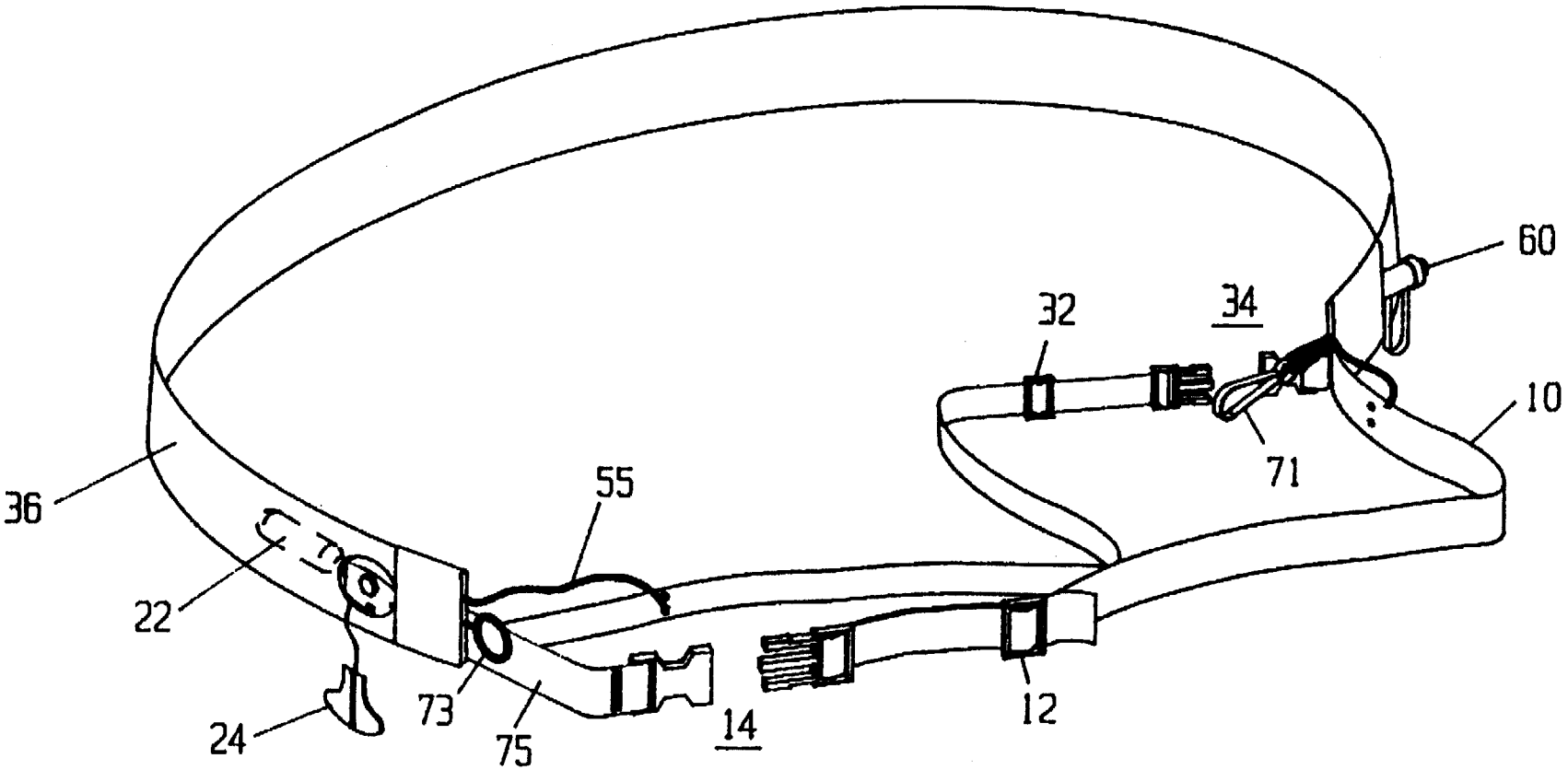
FIGS. 1–4 are perspective views helpful in an understanding of a preferred embodiment of the invention.

Referring to FIGS. 1–4, the inflatable swimmer's safety belt, life preserver/life vest of the invention incorporates a first, substantially hollow belt 10, constructed of a rugged, nylon, polyurethane-coated material or similar leak-proof composition and adjustable in length in any appropriate manner by clip 12, and closeable by a releasable clasp arrangement, for example, 14. As will be appreciated, the arrangement of the clip 12 and the releasable clasp 14 is such as to enable the size of the belt 10 to be adjusted i.e. to fit the length of the belt 10 so as to encircle the waist of a wearer. As will be particularly seen from FIG. 2, the belt 10 is provided with folded, overlapping sections 16 which, when eventually deployed, are pinched-off into separate interconnecting sections 18*a*–18*e* as an illustration (FIG. 3), at predetermined intervals 20 along its length.

Also shown in the drawings, as by reference notation 22, is a compressed gas cartridge of a well known type, puncturable by a pin (not shown) moveable with respect to the cartridge 22. As will be appreciated, the cartridge 22 is further coupled with the belt 10 so as to discharge its compressed gas when punctured, and so as to fill the belt 10—and its sections 18*a*–18*e*—in the nature of a tube, similar to a life preserver. A compressed gas cartridge of this type, puncturable by a pin actuator and with a cartridge which can be removeably coupled and replaced after use, is shown and described in U.S. Pat. No. 3,754,731. A carbon dioxide compressed gas cartridge 22 may be employed of 16 gram capacity, although a larger cartridge of 25 grams (or even 35 grams) could be utilized instead, to provide the degree of buoyancy required, depending upon whether this type of personal flotation device is to be used in calm, inland water, on the one hand, or for open, rough or remote water, on the other hand.

As with the inflatable swimmer's safety belt of my U.S. Pat. No. 5,368,512, any type of device may be employed to actuate the pin in puncturing the cartridge 22 to discharge its compressed gas. In FIGS. 1–4, for example, a lanyard 24 may be "jerked" to cause the pin movement to puncture the cartridge 22, as described in U.S. Pat. No. 3,754,731. In a second configuration (not shown herein), a separate "buckle-lift" arrangement may be employed, whereby an "upward-pulling" can cause the actuation to puncture the cartridge in manners similar to those described in my two aforementioned United States Patents.

With either method of actuation—and as so far described—the belt 10 may be worn by a swimmer, or simply as a safety belt by an occupant of a water craft, and when adjusted for comfort and size by the clip 12 (or by any other type of clip and clasp arrangement 14) closes to fit the waist of the wearer, with the compressed gas cartridge 22 then sealed. If the swimmer wearing such belt then finds himself or herself in difficulty in the water —or if the occupant of the water craft, boat, canoe, or kayak wearing such belt inadvertently falls out into the water—the lanyard 24 can be "jerked" (or the buckle "lifted" in the noted alternative arrangement) accordingly, so as to cause the puncture of the cartridge 22 and the automatic filling of the hollow belt 10 and its sections 18*a*–18*e* as a life preserver tube. In this manner, the belt 10 and its component parts as so described comprise an inflatable belt which inflates into a life preserver when the compressed gas cartridge 22 is activated.

Figure 2:
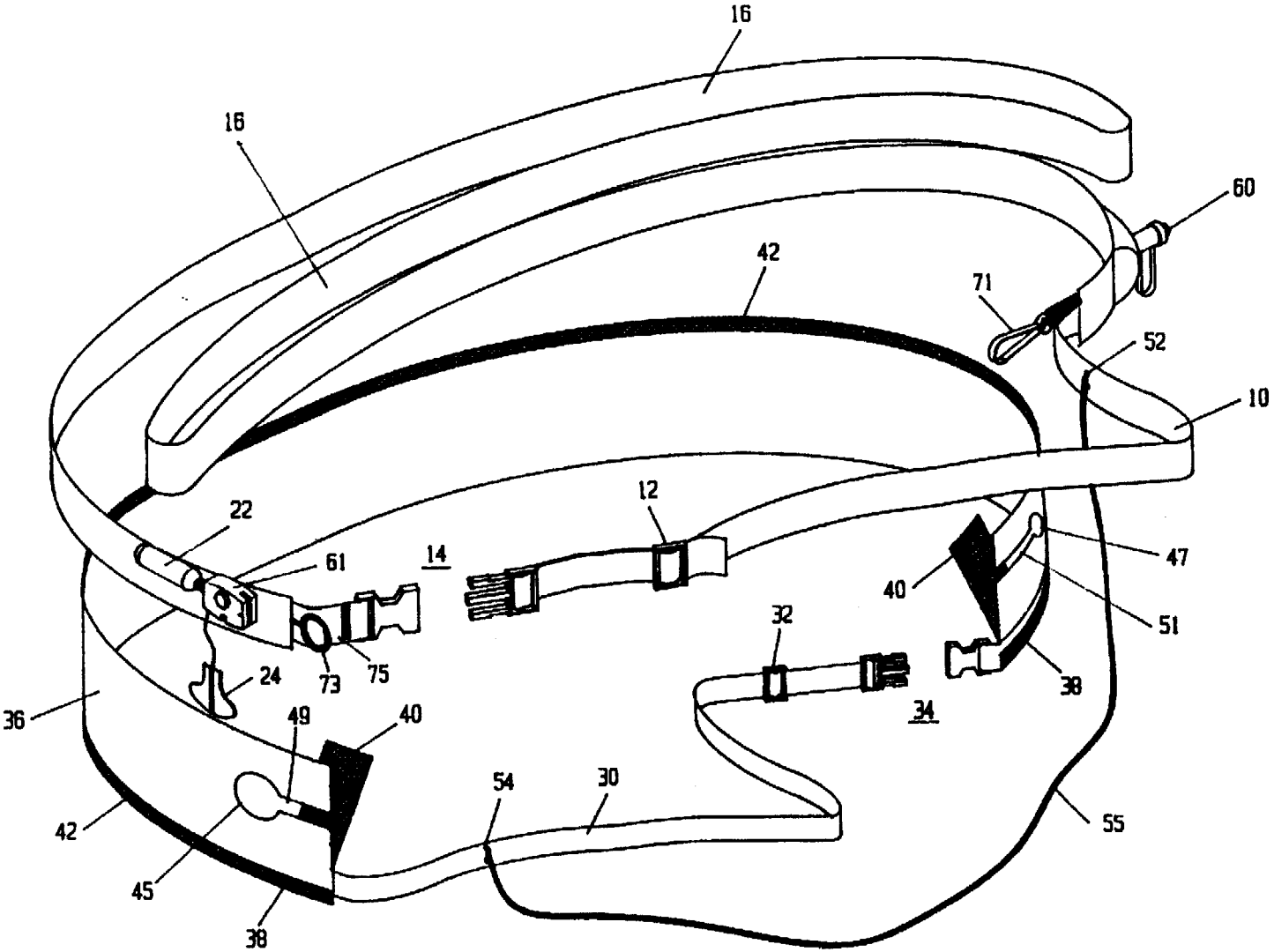
Figure 3:
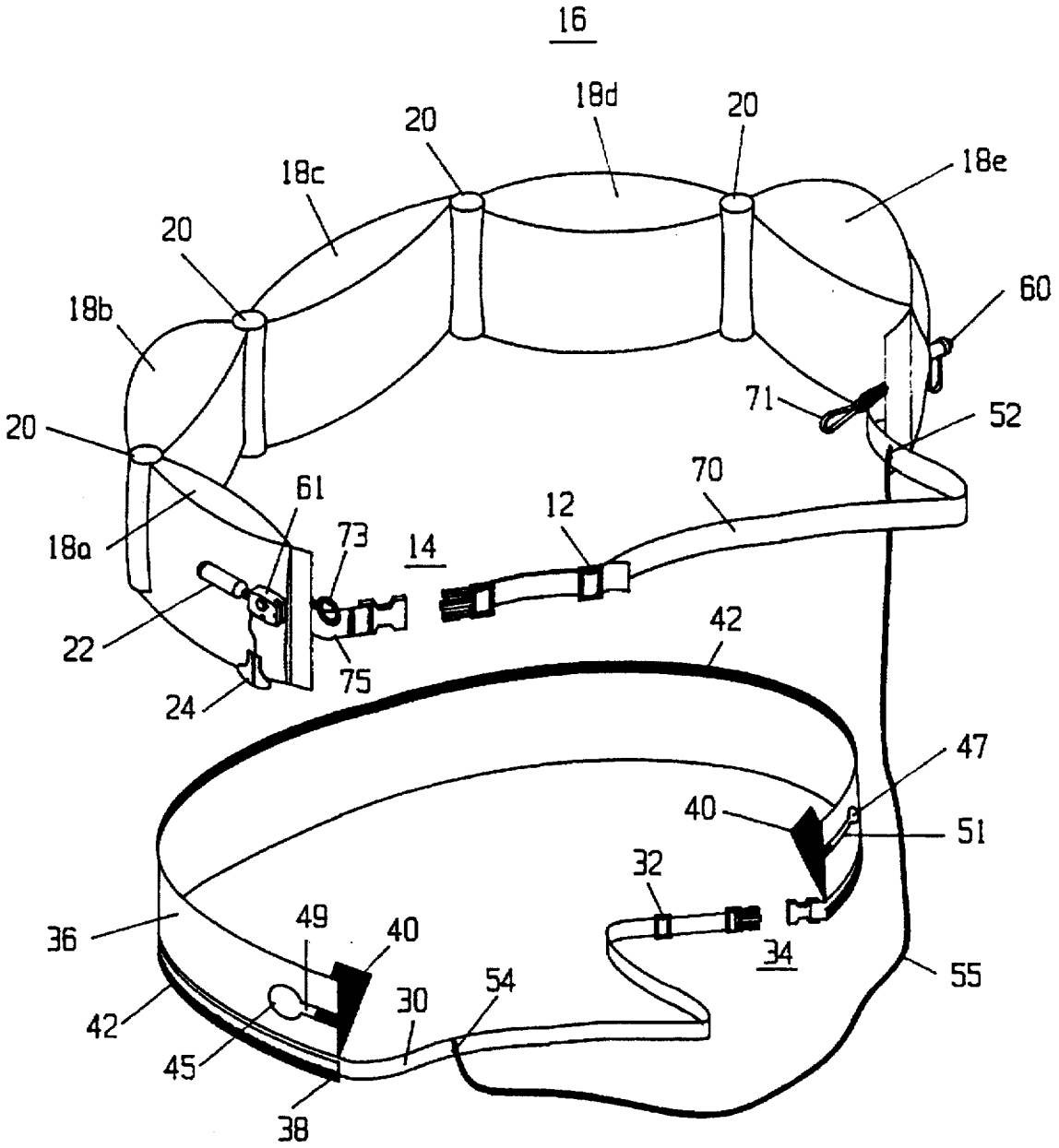
Figure 4:
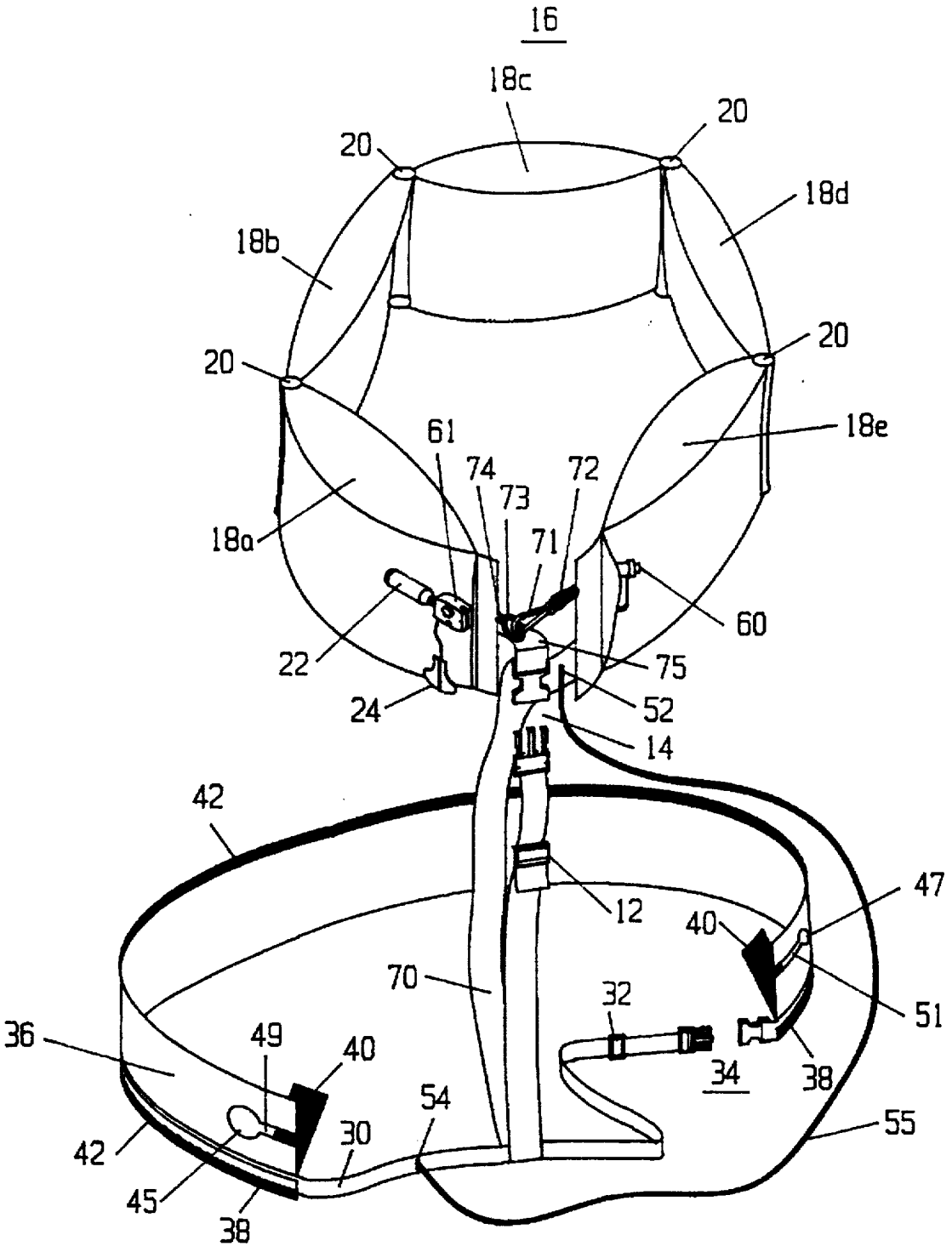

In accordance with the teachings of the present invention, as with that of my U.S. Pat. No. 5,368,512, a second belt 30 is also provided, similarly constructed of a rugged nylon, polyurethane-coated material or similar leak-proof composition, adjustable in length in any appropriate manner, as by the clip 32 and releasable clasp 34 to encircle the waist of the wearer. As will be appreciated, this second belt 30 is of a conventional construction to be worn about the waist, underlying the first belt 10, and contradistinct therefrom in not being hollow, or sectionalized as at 18*a*–18*e*. Moreover, and as illustrated in FIGS. 2,3, and 4, this "conventional" belt 30 forms part of a jacket 36 which fits about the waist of a wearer and within which the overlapping folds 16 of the first belt are temporarily enclosed and secured (FIG. 1). To such end, and as shown in FIGS. 2,3, and 4, the ends of the second belt 30 are fixedly secured at 38—as by a "tacking" —and including a Velcro or other adhesive fastener 40 in temporarily holding the folded sections 16 of the belt 10 in place prior to deployment—in which event the unfilled sections 18*a*–18*e* are enclosed within the jacket 36, and hidden from sight. Reference notation 42 in FIGS. 2,3, and 4, will be understood to be separate Velcro, or other adhesive securement in wrap-over, and enclose the sections 18*a*–18*e* within the jacket 36, before the puncture of the compressed gas cartridge 22.

As so far described, the inflatable swimmer's safety belt, life preserver/life vest of the invention will be appreciated to thus take on the appearance of FIG. 1 prior to actuation, wherein the first belt 10 overlies the second belt 30 about the waist of the wearer, and with the temporarily secured, folded, overlapping unfilled sections 18*a*–18*e* enclosed within the jacket 36. In this respect, then, the second belt 30 will be understood to take on the appearance of a "jacket belt", in which the "inflatable belt" 10 is packed prior to use of the invention, and into which the "inflatable belt" is re-packed after actuation.

As was previously mentioned, one of the major disadvantages of previously available personal flotation devices was their inherent bulkiness. Simply stated, no matter what their advantage in keeping people from drowning, their large bulk was such that they were not often worn. At the same time, they were inherently heavy, especially with the Off-Shore Life Jacket (Type I PFD) and Near-Shore Buoyant Vest (Type II PFD) varieties. Even though they were the most effective in keeping wearers face-up in the water, and kept tiring but conscious wearers similarly in a tilted head-back position, almost no wearer liked to keep them on even if only for a few moments on board the boat or watercraft. Added to this was the limitation that one could not easily take even a few swimming strokes while wearing this type of personal flotation device—so that it is easily seen why some type of improvement is desired.

With the present invention, the "jacket belt" is constructed so that the Velcro, or other adhesive securements 40, are sewn on the outside making packing the belt simple, and user friendly. At the same time, the "jacket belt" is provided with a pair of holes 45, 47, with adjacent slits 49, 51, which allow the "jacket belt" to freely break open when the inflatable belt is deployed. Such holes 45, 47, the slips 49, 51, and the Velcro strips 40 combine to make the belt of the invention easier to pack, and reliable when inflating. This construction of holes, slits, and the location of the Velcro or adhesive securements permits an easy folding over of the "jacket belt", a snug packing of it, and the use of reduced dimension for the first belt 10 and the second belt 30. One end result of such construction is to streamline the inflatable swimmer's safety belt of the invention, to the extent that a reduced weight towards 12 ounces is attainable, as compared to virtually all other life-vests, both solid and fully inflatable, which can be of up to several pounds heavier. When, at the same time, the overlapping sections 16 are of rectangular shape and of the "Z-fold" illustrated in FIG. 2, the belt of the invention can be made to take on the shape of that in FIG. 1, giving the swimmer's safety belt a smooth, streamlined appearance, and fashionable to the extent that it could be worn for hours on end, not only on a boat or other watercraft, but just by a person desirous of entering the water to swim.

Reference notation 60 in FIGS. 1–3 will be appreciated to comprise a removable cap which permits the release of the compressed gas from the section 18*a*–18*e* when it is desired to refold the belt 10 for placement into the "jacket belt" enclosure after use, or to manually fill the sections by wearer's breath, and where the sections 18*a*–18*e* may tend to lose $CO_2$ gas or air in the event that the inflatable swimmer's safety belt is worn in the water for a prolonged period of time. The holes 45 and 47—together with their respective slits 49 and 51—will be seen to accommodate the compressed gas actuator 61 controllable by the lanyard jerk 24 and the removable cap 60, respectively. (See FIG. 1)

As will thus be understood by those skilled in the art, upon jerking of the lanyard 24, the compressed gas cartridge 22 will be appreciated to not only fill the belt 10 and/or its sections 18*a*–18*e*, but will also act to unfold and expand outwardly the folded-over sections 18*a*–18*e*, previously held within the jacket enclosure 36. More specifically, the filling by the compressed gas which is released will be seen to unfurl the Velcro sections 40 and 42, so as to increase the length of the belt 10, to free it from the enveloping confines of the enclosure 36, and to form the life preserver of increased length which results so as to permit the belt 10 to raise over the chest area towards the wearer's arm level—done automatically as the inflated sections 18*a*–18*e* ride up in the water. Depending upon the amount of the hollow belt 10 initially overlapped, and on the amount of the belt 10 devoted to receive the inflating gas, the unfolding and outward expansion of the belt 10 can be predetermined, to allow the belt to ride under the armpits of the wearer, and to thereby hold the wearer substantially vertical in the water. In a preferred embodiment of the invention, the overlapping belt portions 18*a*–18*e* were selected so that with a carbon dioxide compressed gas cartridge 22, the length of the belt 10, when filled, increased by approximately 10-inches, to allow the belt 10 to rise to the armpits of the wearer, from its initial position at the wearer's waist.

Further, and in accordance with the teachings of the invention, a tether is included between an underside surface of the belt 10, (as at 52) and a topside surface of the belt 30 (as at 54). Such a tether is identified by the reference notation 55 in FIGS. 1–4, and is selected of a length to restrict the upward riding of the belt 10 when expanded. In such manner, the tube so formed is prevented from riding over the shoulders and/or the head of the user, to become otherwise "free". The inflatable swimmer's safety belt of the invention can then be used as a life preserver.

Figure 5:
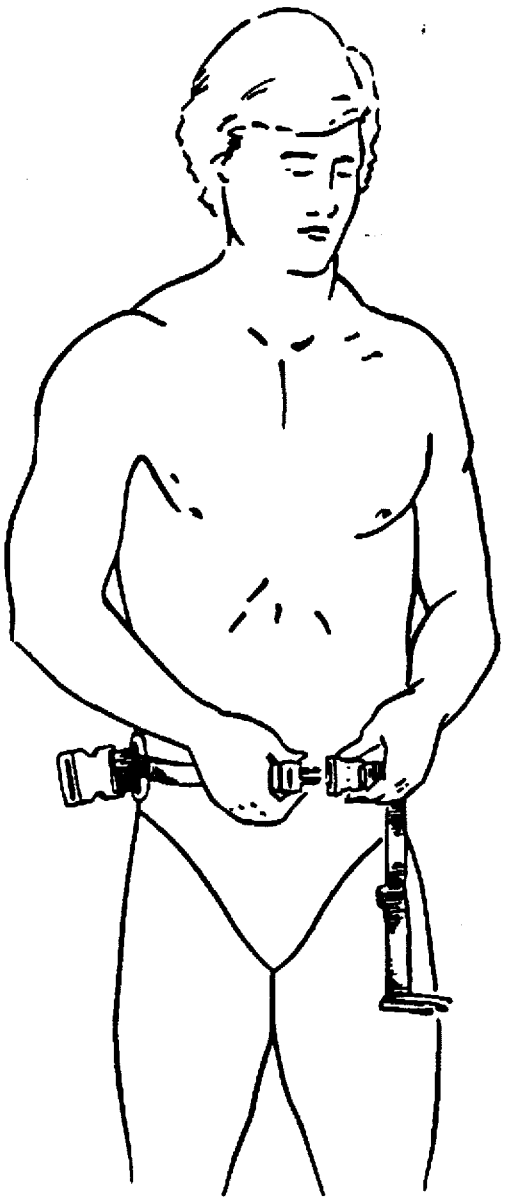
FIGS. 5–10 are illustrations helpful in understanding how the inflatable swimmer's safety belt of the invention can be utilized as a life preserver.
Figure 6:
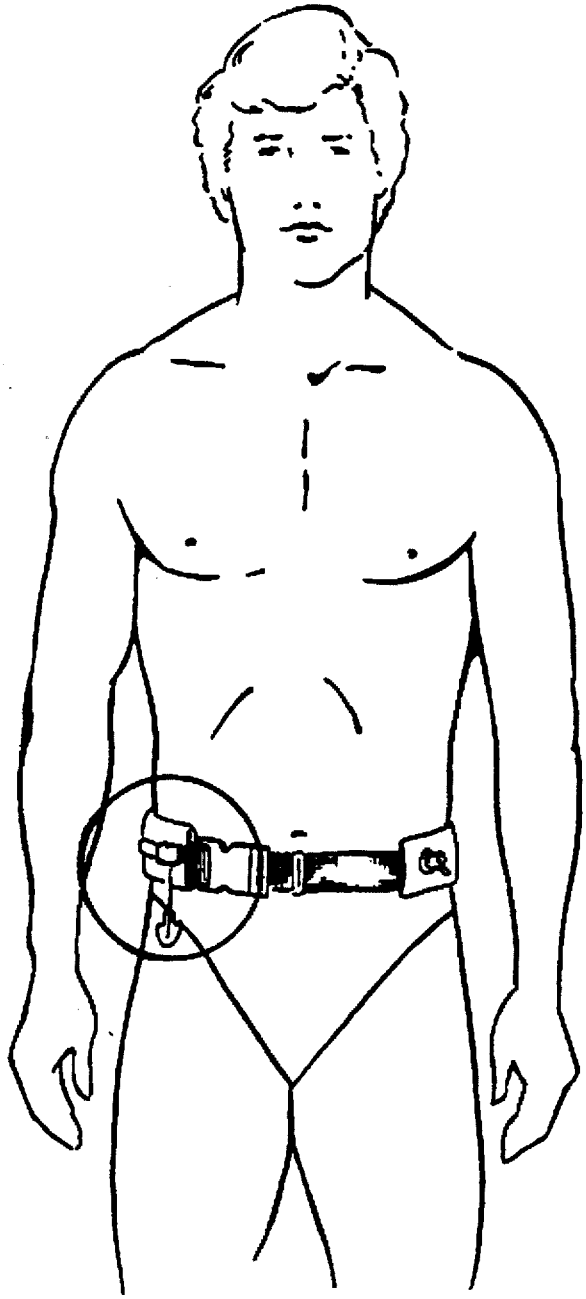
Figure 7:
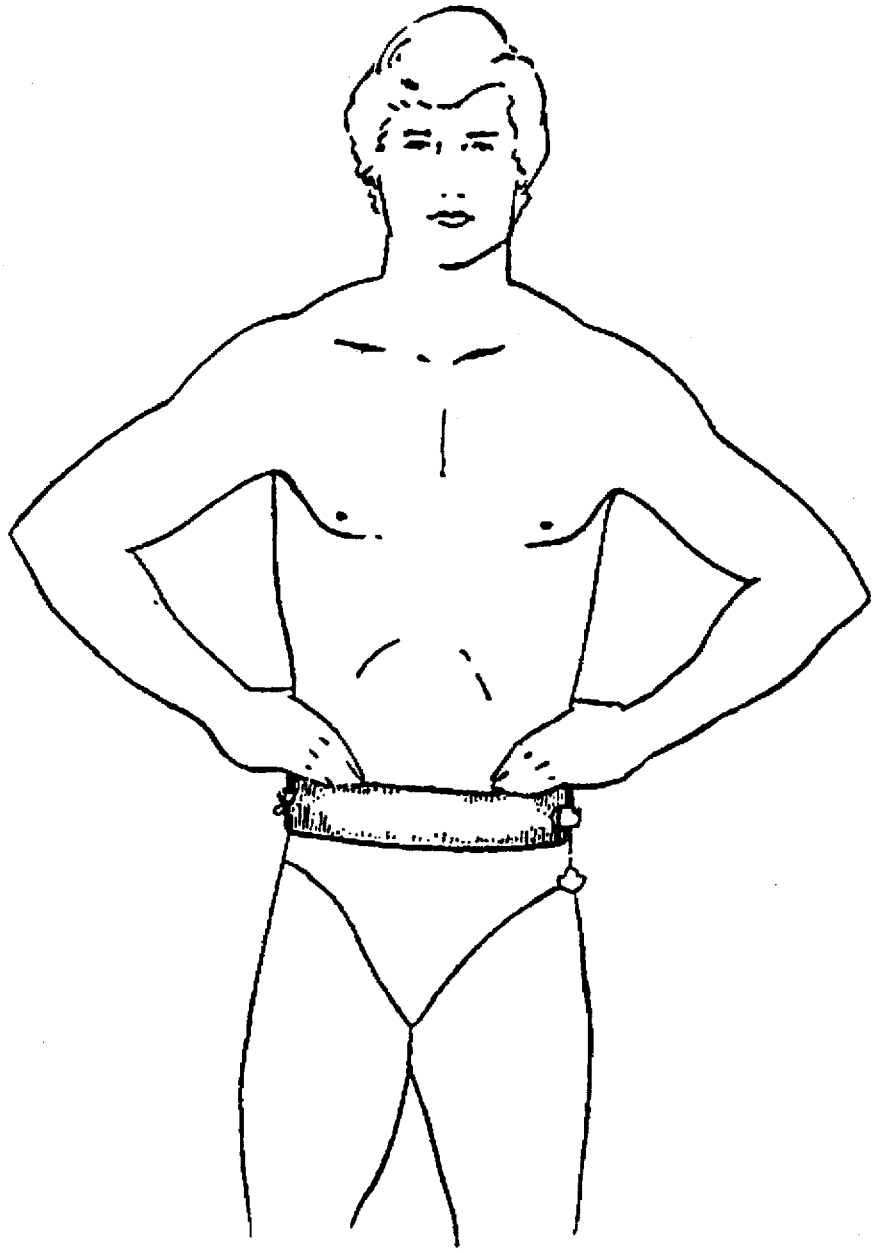
Figure 8:
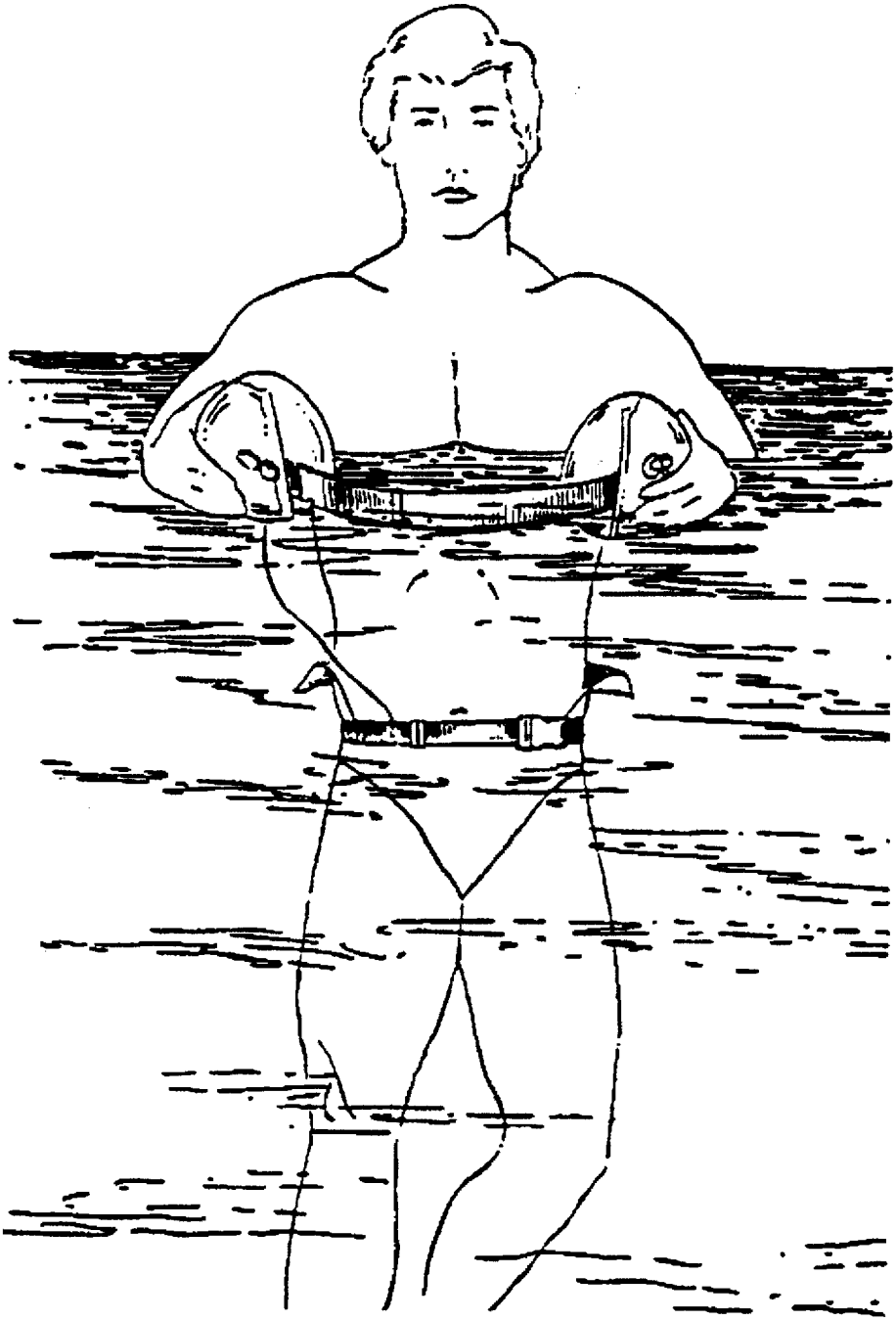
Figure 9:
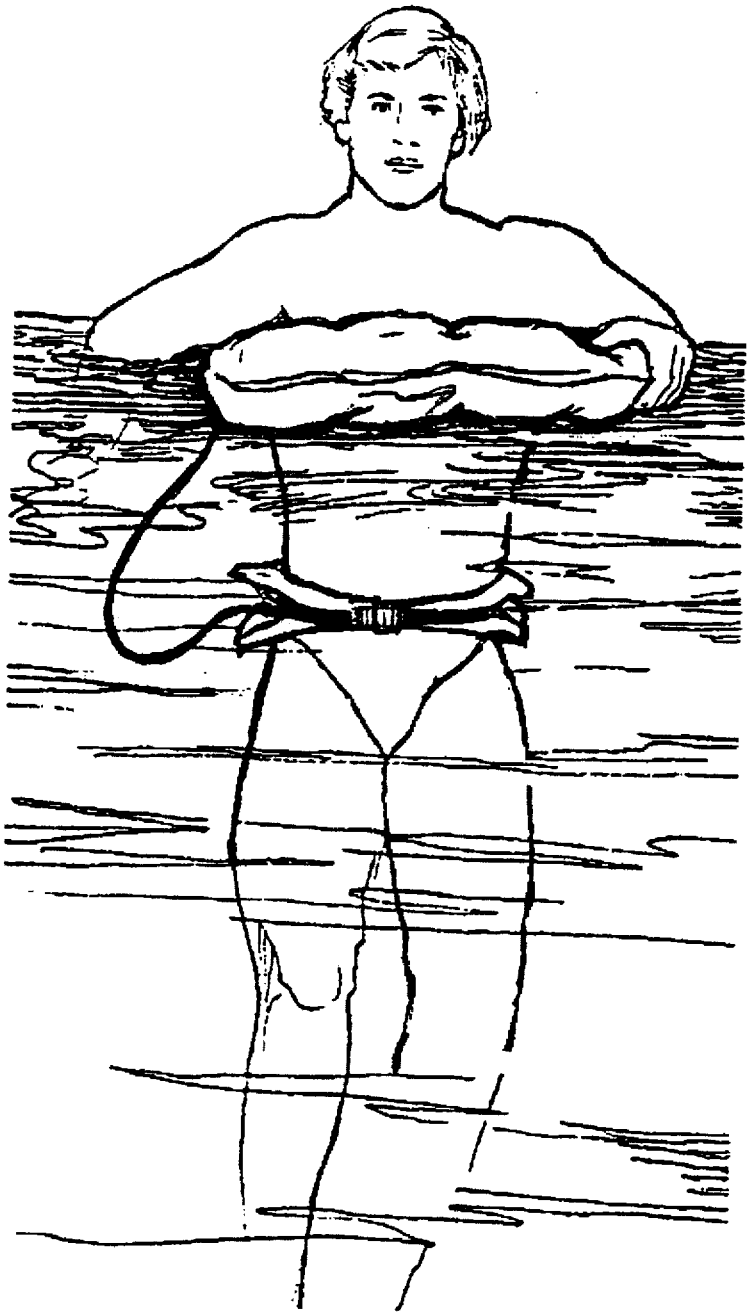
Figure 10:
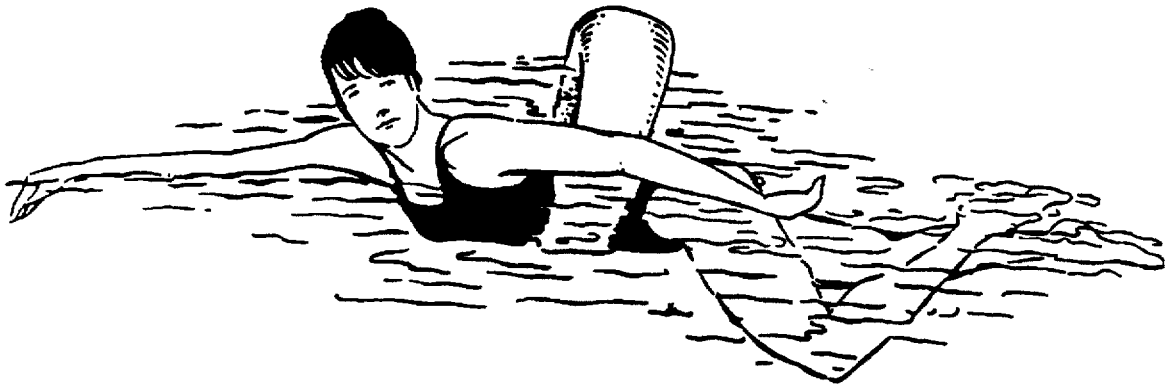
Figure 11:
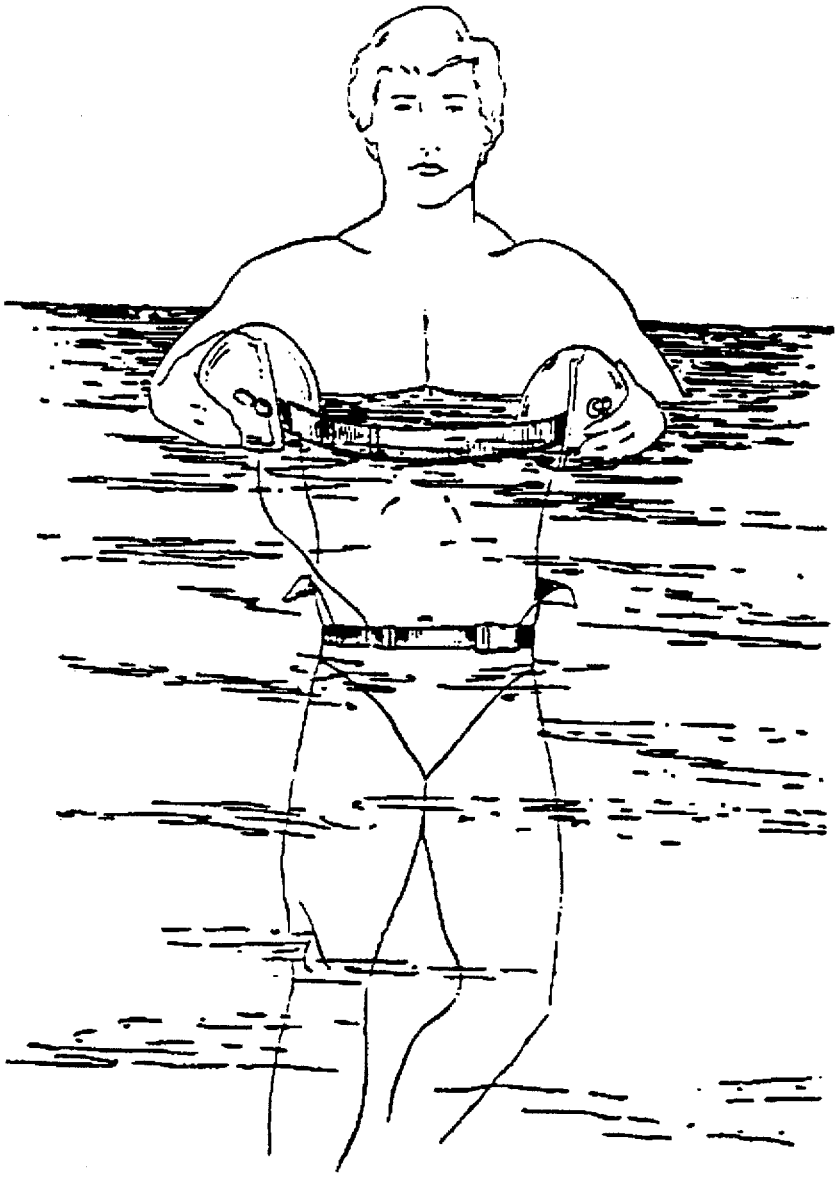
FIGS. 11–18 are illustrations helpful in understanding how the inflatable swimmer's safety belt of the invention can be converted from a life preserver to a life vest.
Figure 12:
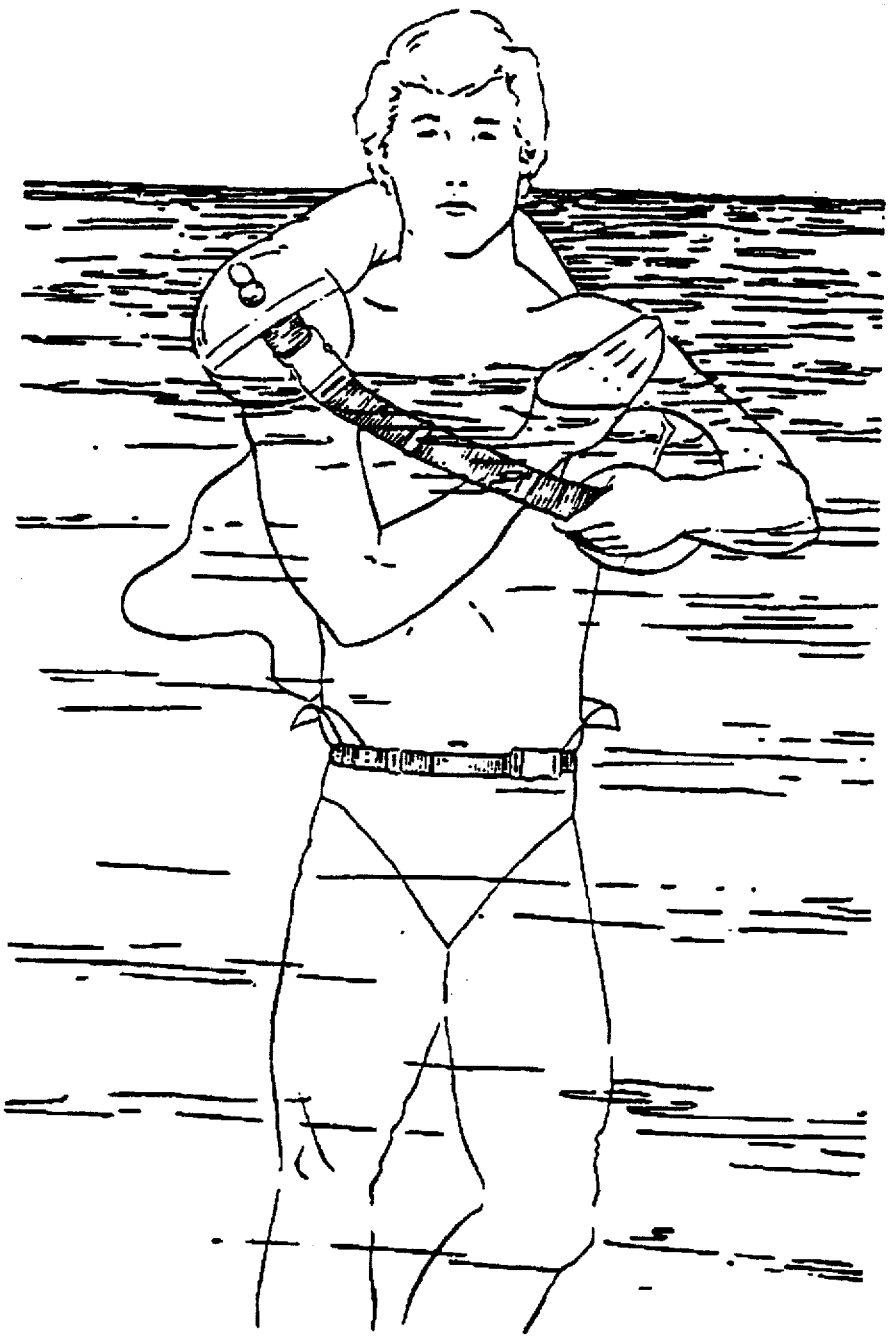
Figure 13:
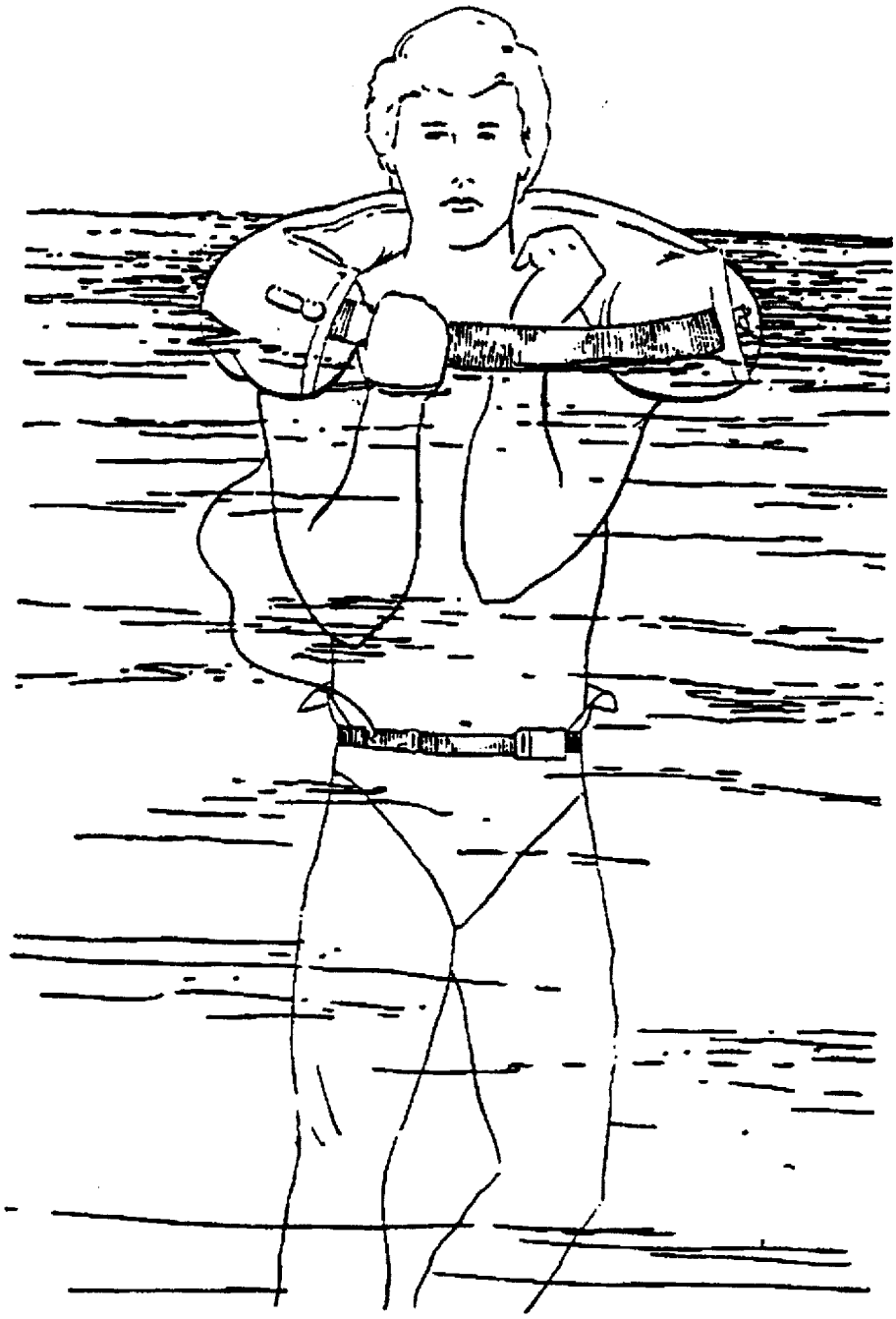
Figure 14:
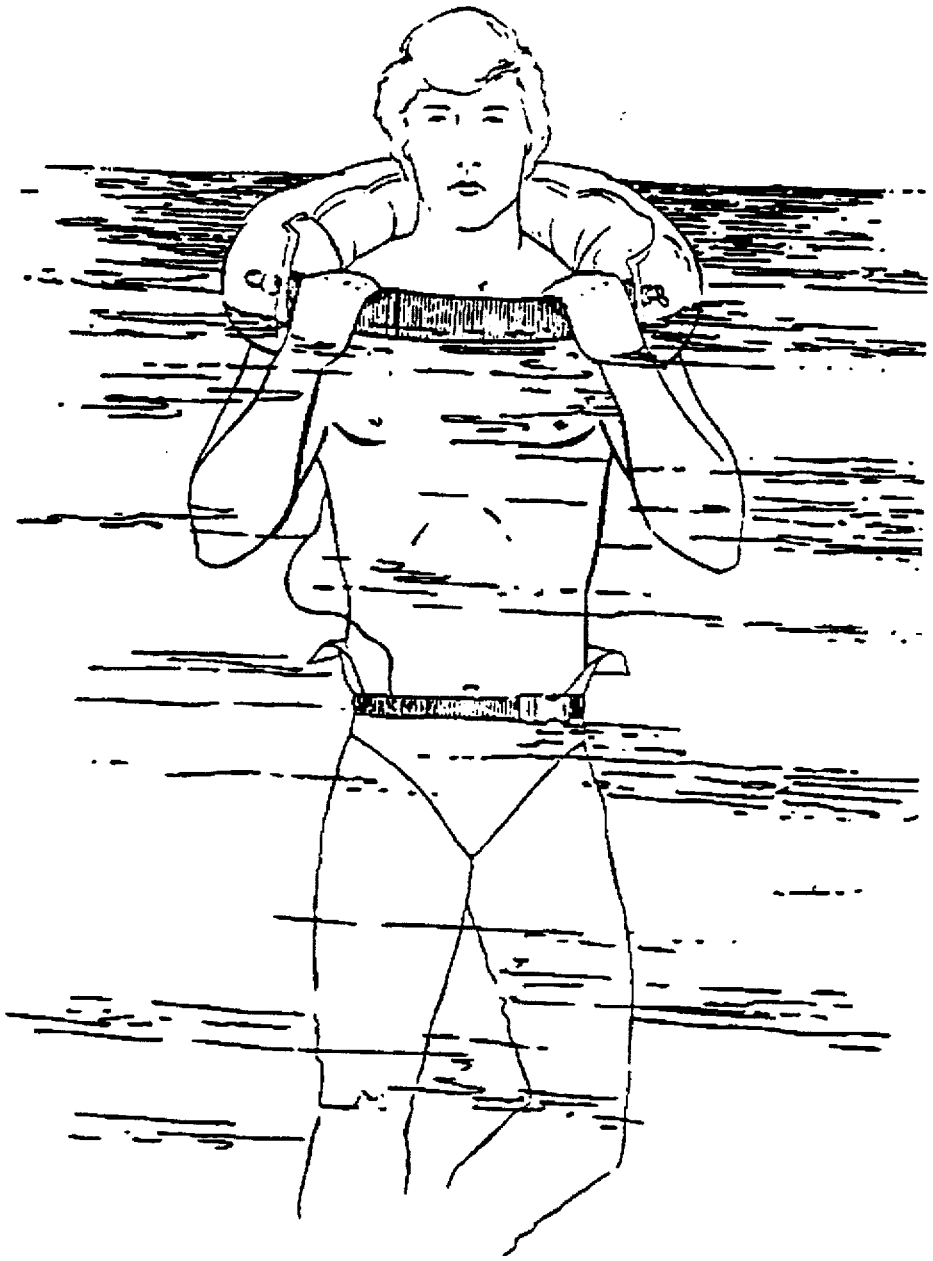
Figure 15:
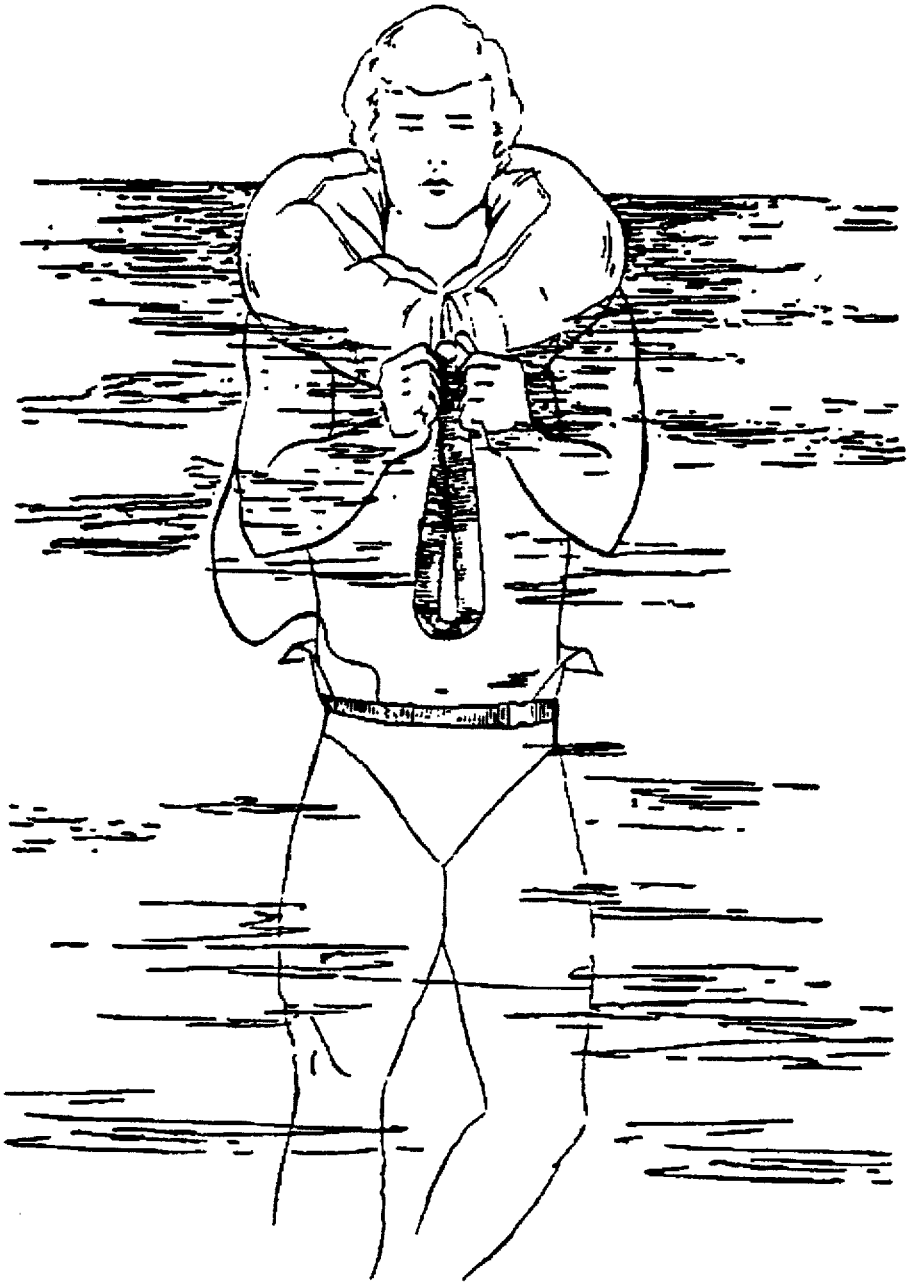
Figure 16:
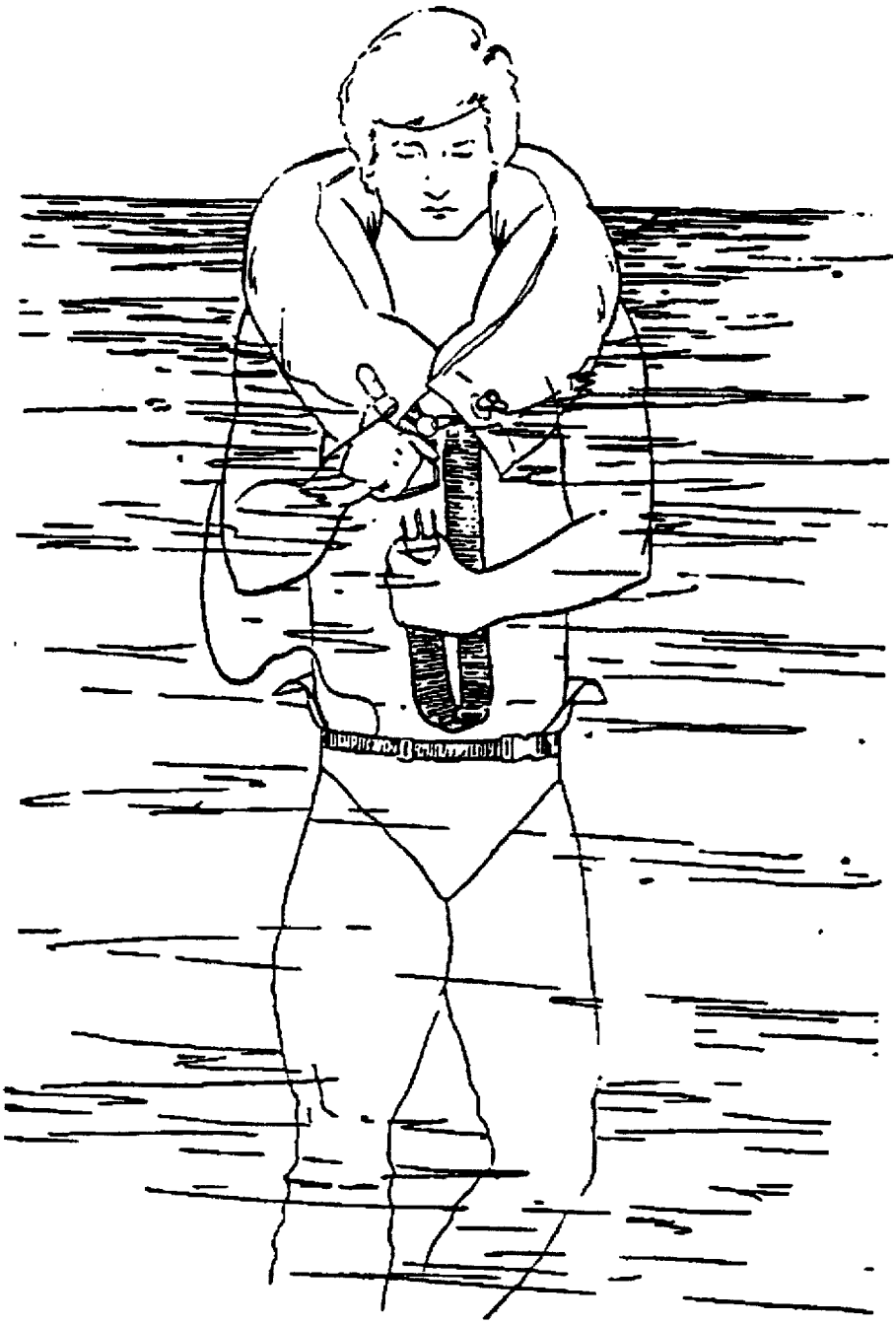
Figure 17:
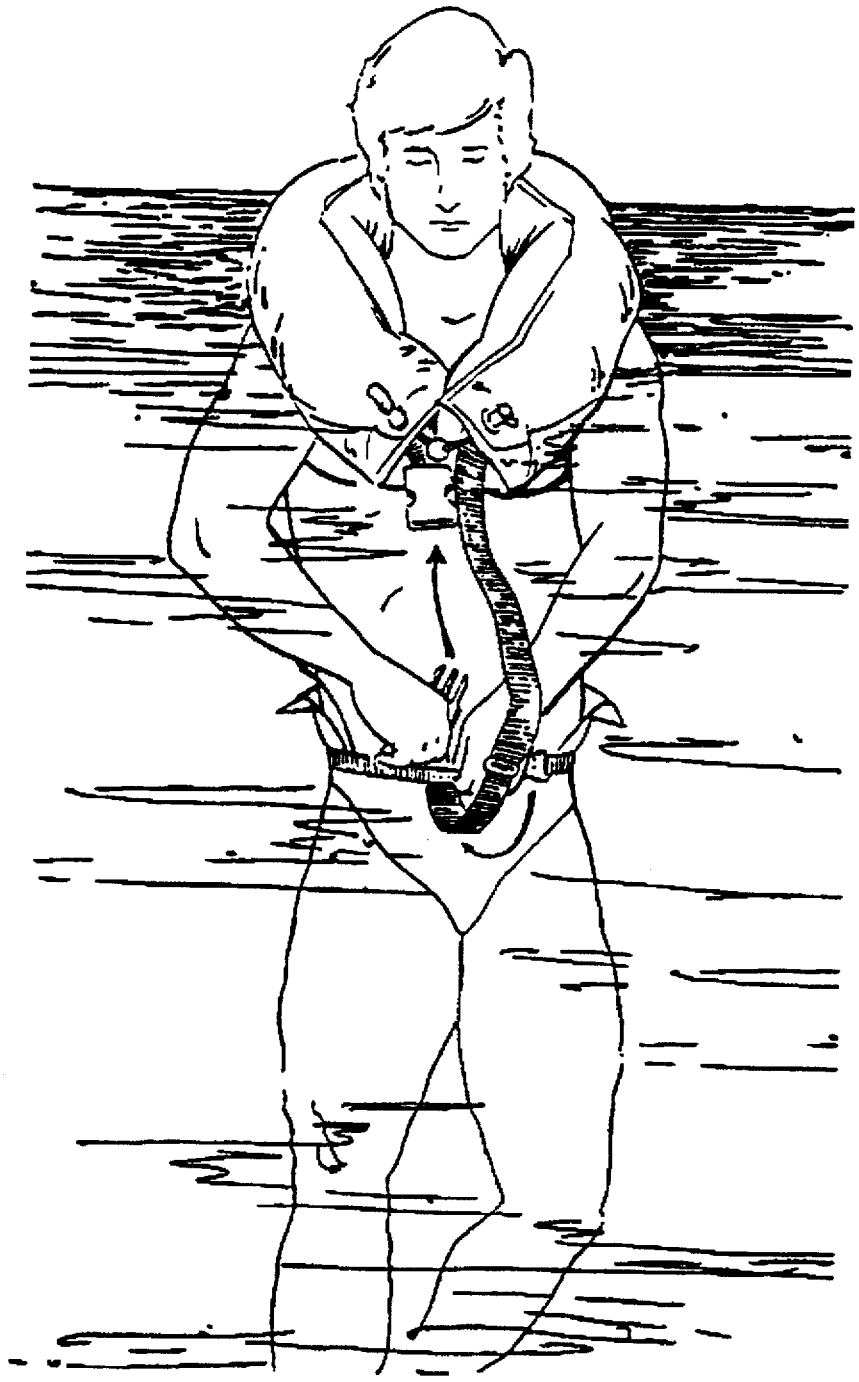

FIGS. 5–10 illustrate the manner of using the swimmer's safety belt of the invention as a life preserver. In FIG. 5, the small belt 30 is adjusted to size and clasped by the clip 32 and closed by the clasp 34 FIG. 6 follows from adjusting the larger belt 10 to size by the clip 12 and closing it by the clasp 14, so that the lanyard 24 hangs down freely. Rotating the belts 10 and 30 to the back, as shown in FIG. 7, then allows the wearer to swim freely about. If the wearer tires while swimming, or if the belt combination is worn by a non-swimmer who accidentally falls into the water, the lanyard 24 is jerked down sharply, and the belt 10 and its folded-over sections 18*a*–18*e* instantly inflate to the position shown in FIG. 8, where the life preserver inflates over the chest and under the arms for maximum stability. To rest in the water in this way, the wearer rotates it back to the front as in FIG. 9. If rotated to the back again, as in FIG. 10, the safety belt allows the person to swim freely, and if the wearer then tires, the belt is rotated back to the front, and slid up to the armpit level for rest(FIG. 9).

However, and as noted previously, situations arise where a wearer can excessively tire after swimming with the belt of the invention in its "life preserver" position, or where the wearer tends towards unconsciousness—and in those instances it becomes necessary to keep these wearers face-up in the water. In accordance with this invention, however, the inflatable swimmer's safety belt is convertible from its "life-preserver position" to a "life vest position" in affording maximum safety. To attain this, and as now will be described, the strap of the belt 10 is utilized in a different manner to anchor the "inflatable belt" 16 to the "jacket belt" 36, which remains around the wearer's waist when the life preserver inflates.

Thus, and as shown in FIGS. 3 and 4, the clasp 14 of the first belt 10 is released, and its strap 70 coupled over and under, about the belt 30—vertically—to then be closed again and tightened through the clip 12 to maintain constant the distance between the belt 30 and the then re-joined clasp 14. At the same time, means are provided on the inflatable belt 16 to essentially maintain the life preserver-shape formed when the inflatable belt 16 was secured through the horizontal closing of the clasp 14, in the manner shown in FIG. 3. Such configuration is maintained, according to the invention, through releasable couplings provided adjacent the opposite ends of the belt 16, as by a snap-hook 71 secured to the belt 16, at an underside 72 overlapped by the strap 70. In like manner, a ring 73 is secured at an opposite underside 74, beneath the closure end of the strap 75 where the clasp 14 is secured. In such manner as shown in FIG. 4, the life preserver previously formed by the sections 18*a*–18*e* can be raised above the armpits of the wearer, but restricted to the shoulder and neck area by the straps 70, 75 in holding the inflated sections about the neck.

Figure 18:
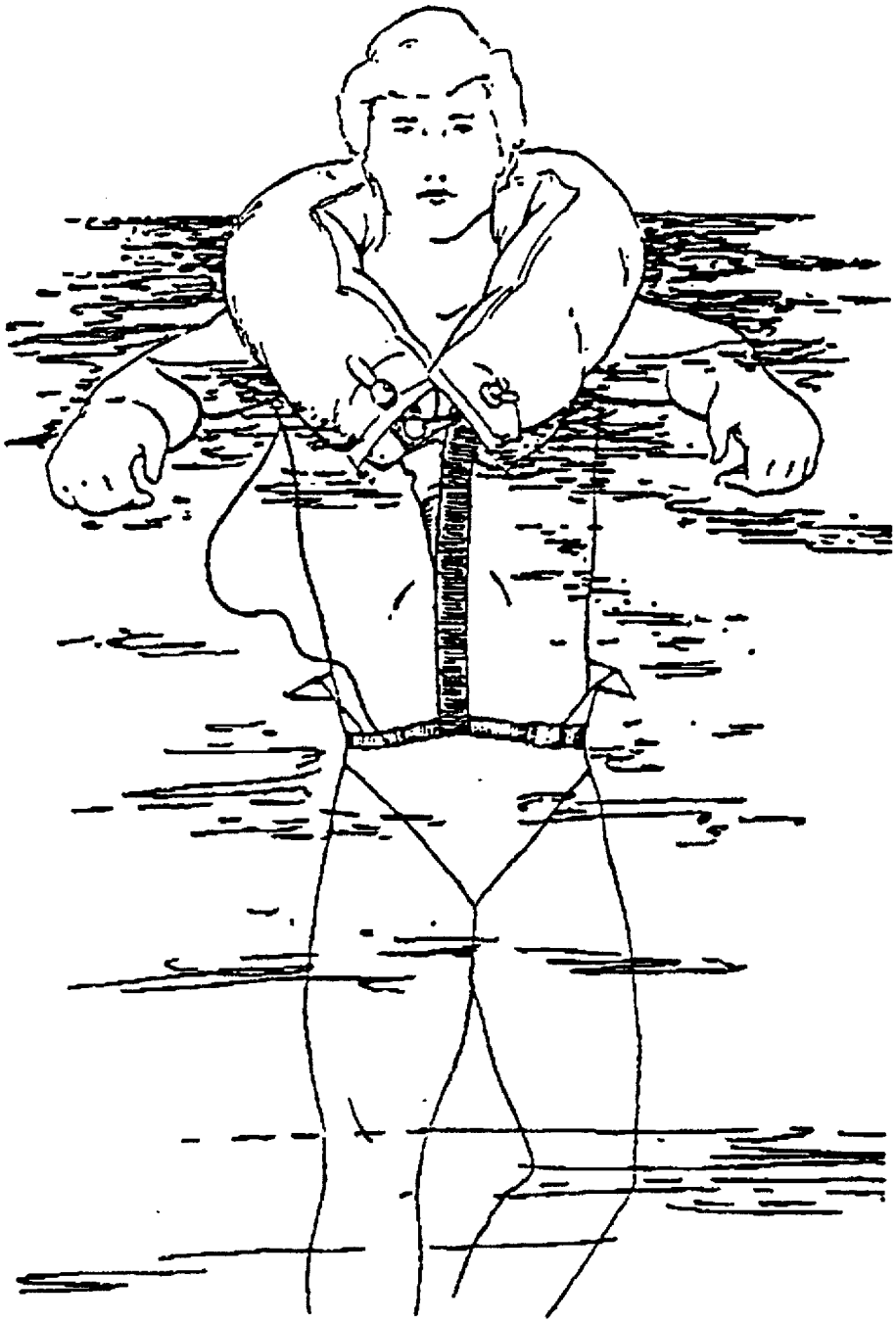

FIGS. 11–18 illustrate this manner of converting the life preserver aspect of the invention to its life vest mode. Thus, in FIG. 11, the life preserver is rotated around to the back, in manner comparable to that of FIG. 8. The right arm of the wearer is then lowered down inside the life preserver to take on the form of FIG. 12. The left arm is then lowered down inside the life preserver as in FIG. 13, to the position where the life preserver is now around the wearer's neck. (FIG. 14) The snaphook 71 and the ring 73 are then joined together (FIG. 15), and the strap 70 released from the clasp 14. (FIG. 16) The strap 70 is then wound around and over the waist belt 30, fit to size by the clip 12 (FIG. 17), and then clasped back together into position (FIG. 18). With the waist belt 30 continued to be in place, the life preserver of the inflatable swimmer's safety belt then is converted to the life vest to support an unconscious or overly tired wearer. When strength is regained, the wearer can reverse the steps in FIGS. 11–18, to begin swimming anew, until tiring later on, and converting the inflatable swimmer's safety belt back to the life vest position. Maximum freedom will thus be seen to result in the life preserver position, with maximum security being attainable in the life vest position.

Figure 19:
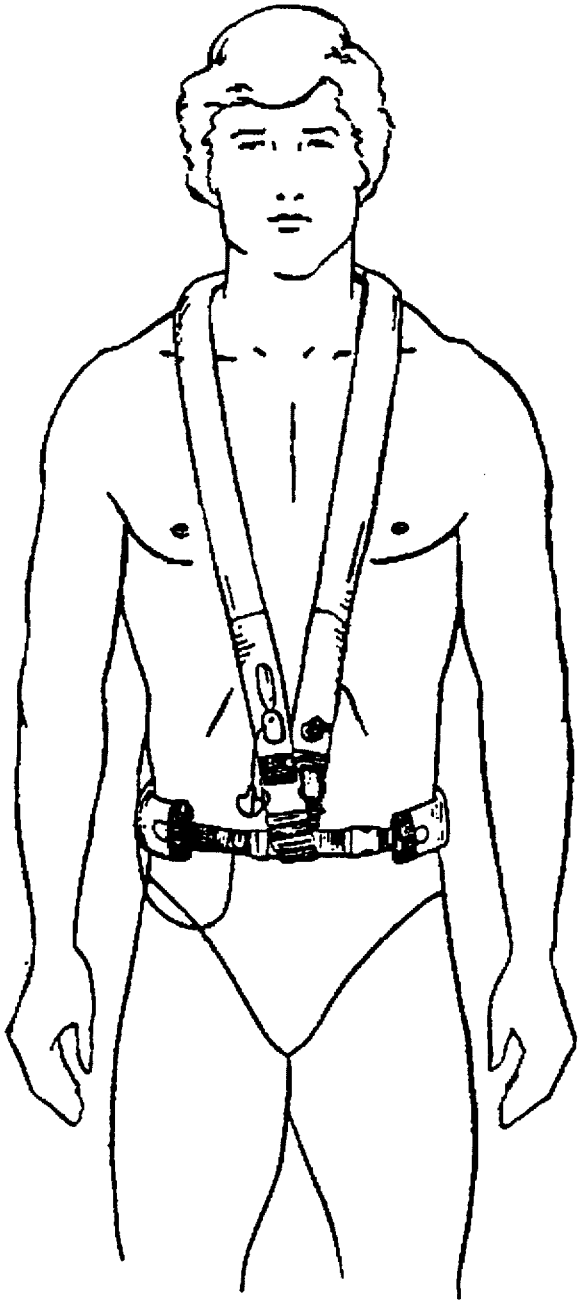
FIG. 19 is an illustration helpful in understanding how the inflatable swimmer's safety belt of the invention can be used directly as a life vest without first having to convert to life preserver use.

Whereas FIG. 7 shows the inflatable swimmer's safety belt being worn, ready for inflation to the life preserver position of FIGS. 8 and 9, FIG. 19 shows the wearing of the swimmer's safety belt where it might be intended for use initially as a life vest. Shown prior to the compressed gas cartridge 22 being punctured, the strap 70 winds about the neck of the wearer, and about the waist belt 30, and with the lanyard 24 and oral inflator 60 being readily accessible.

Figure 20A:
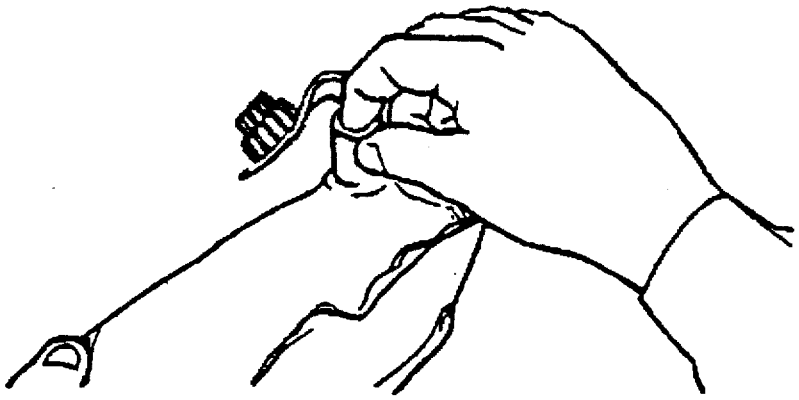
FIGS. 20–25 are helpful in understanding how to pack the inflatable swimmer's safety belt of the invention after use.
Figure 20B:
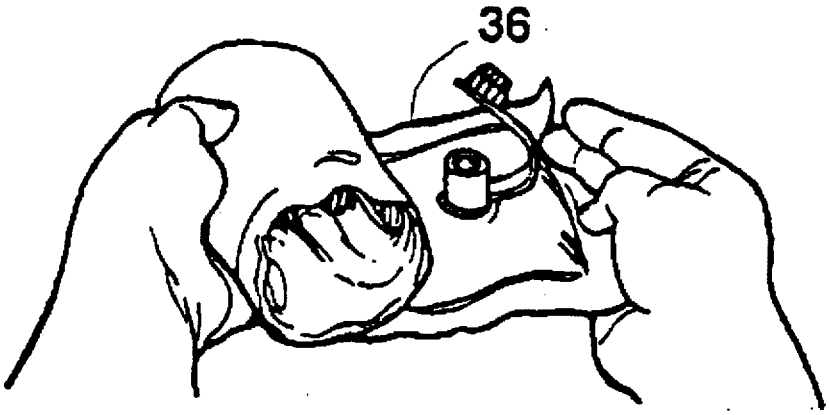
Figure 21A:
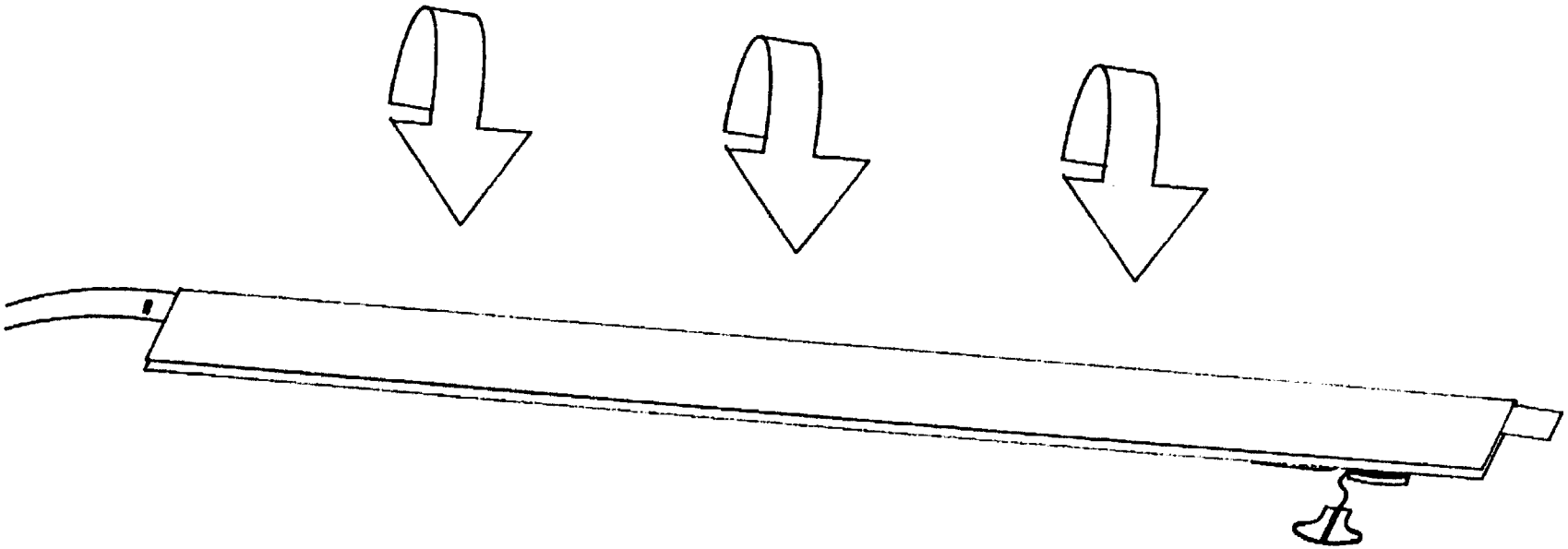
Figure 21B:
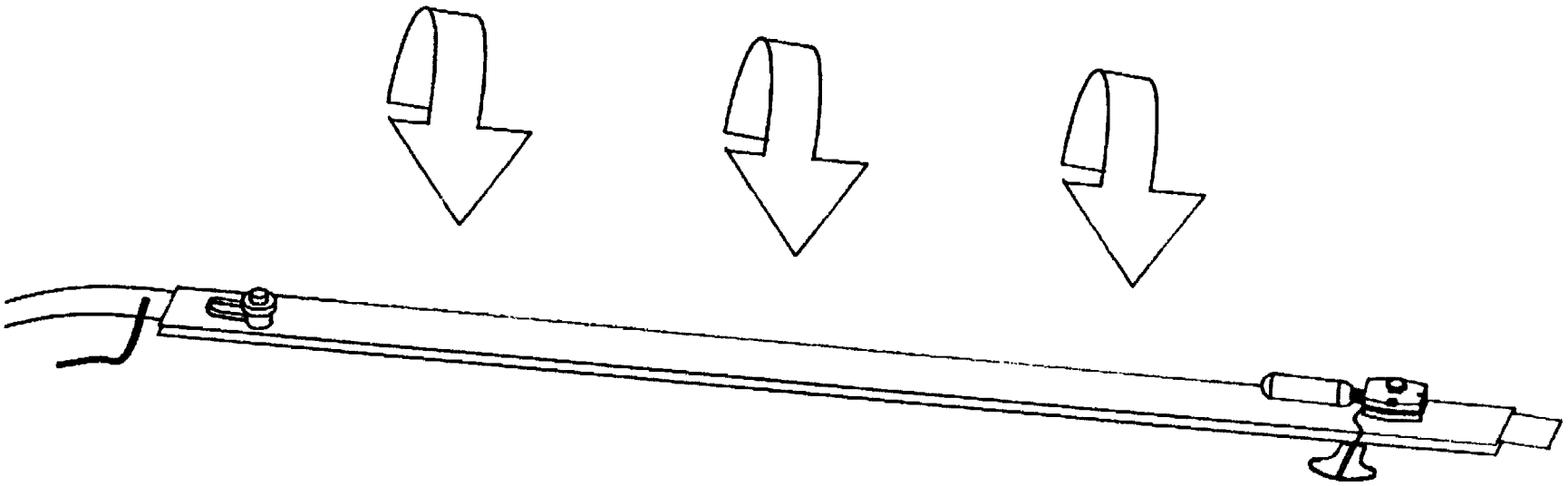
Figure 22:
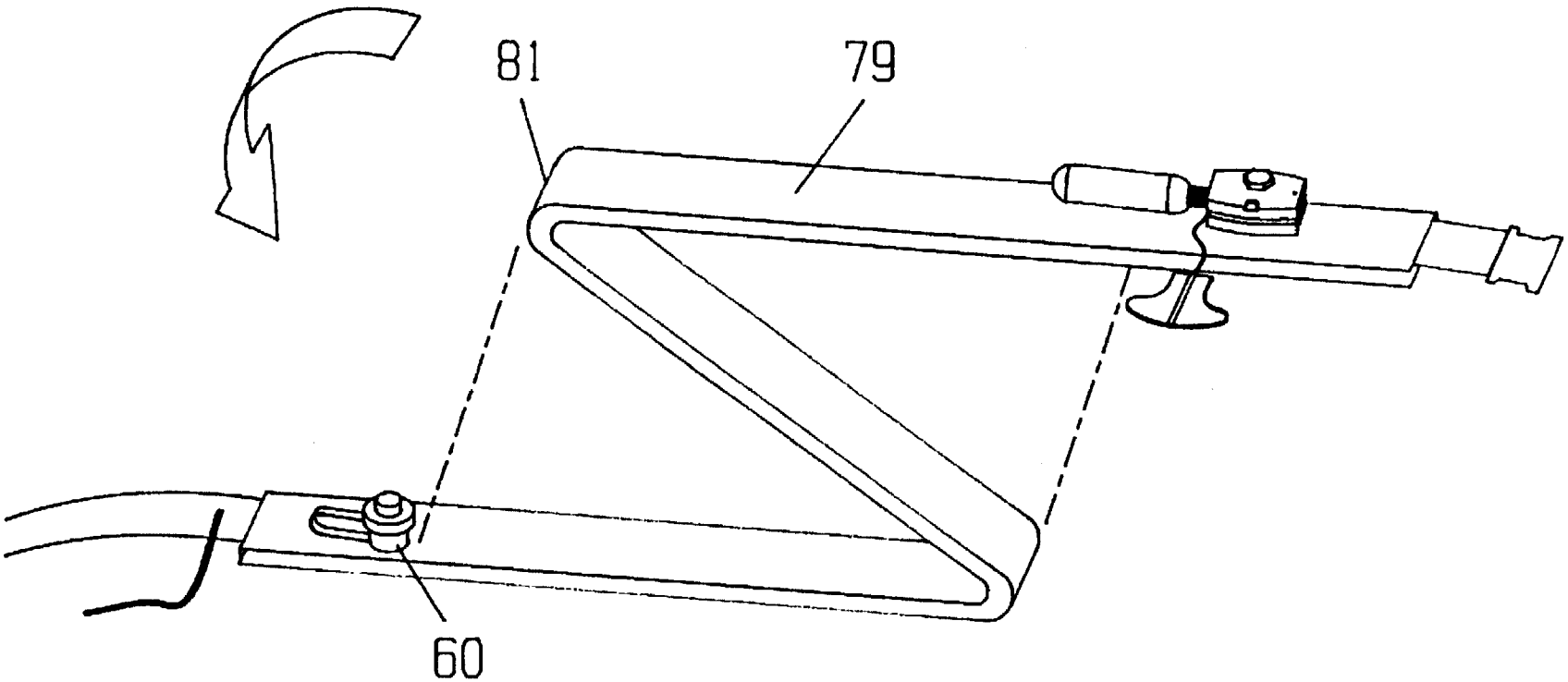
Figure 23:
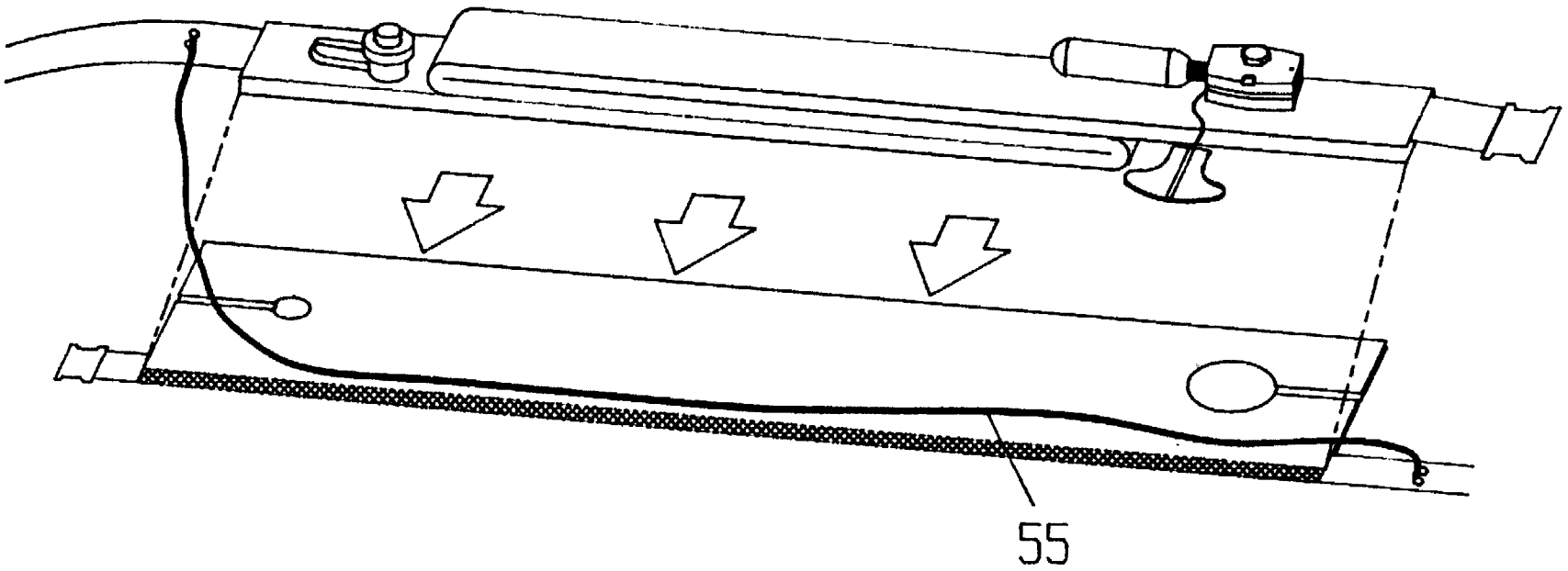
Figure 24A:
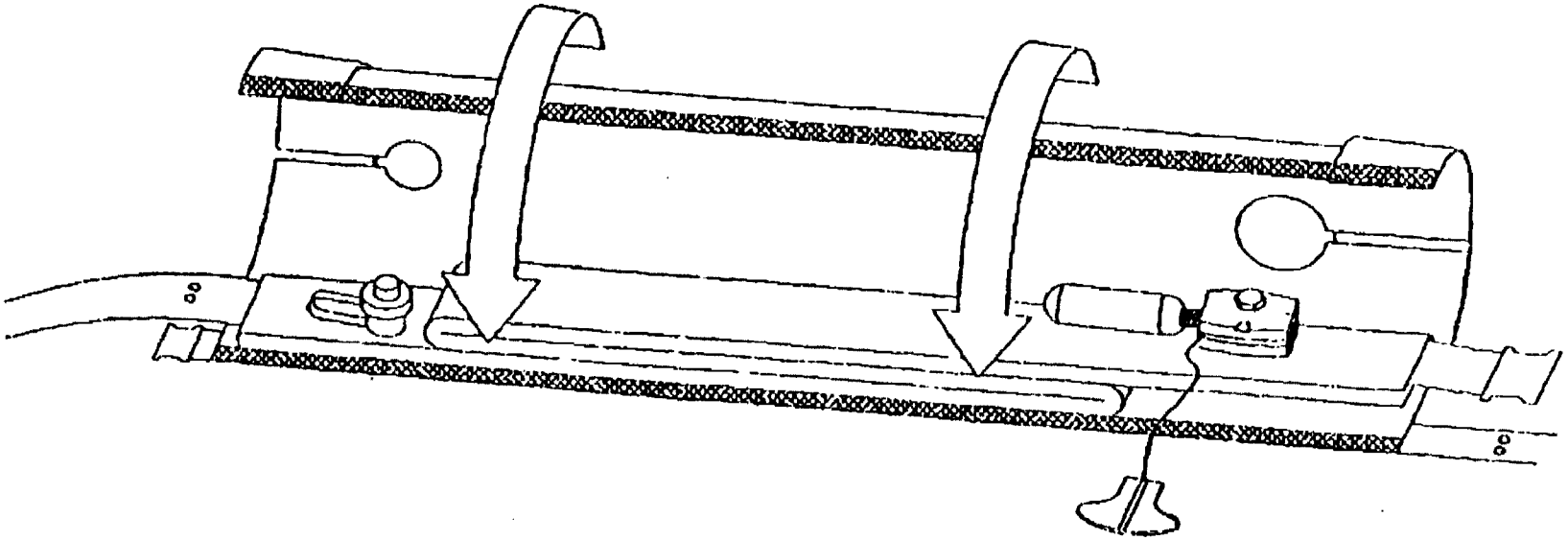
Figure 24B:
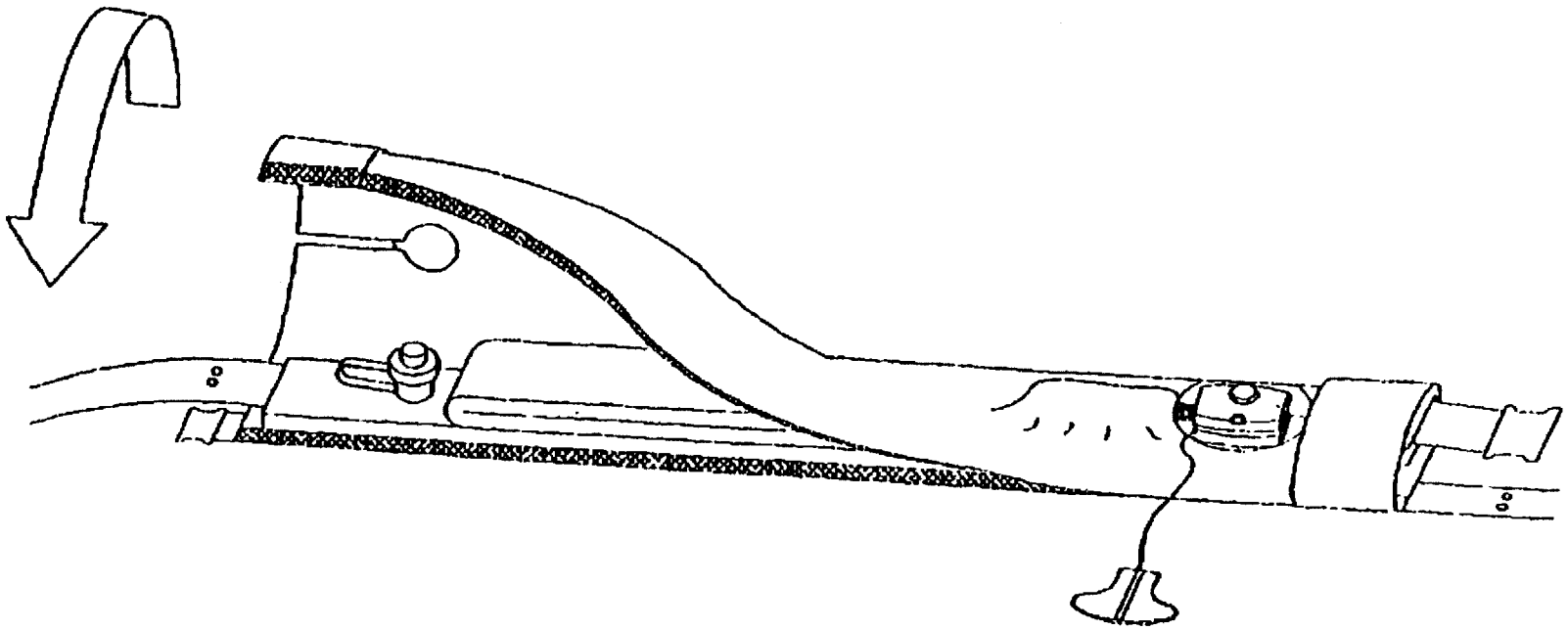
Figure 24B:
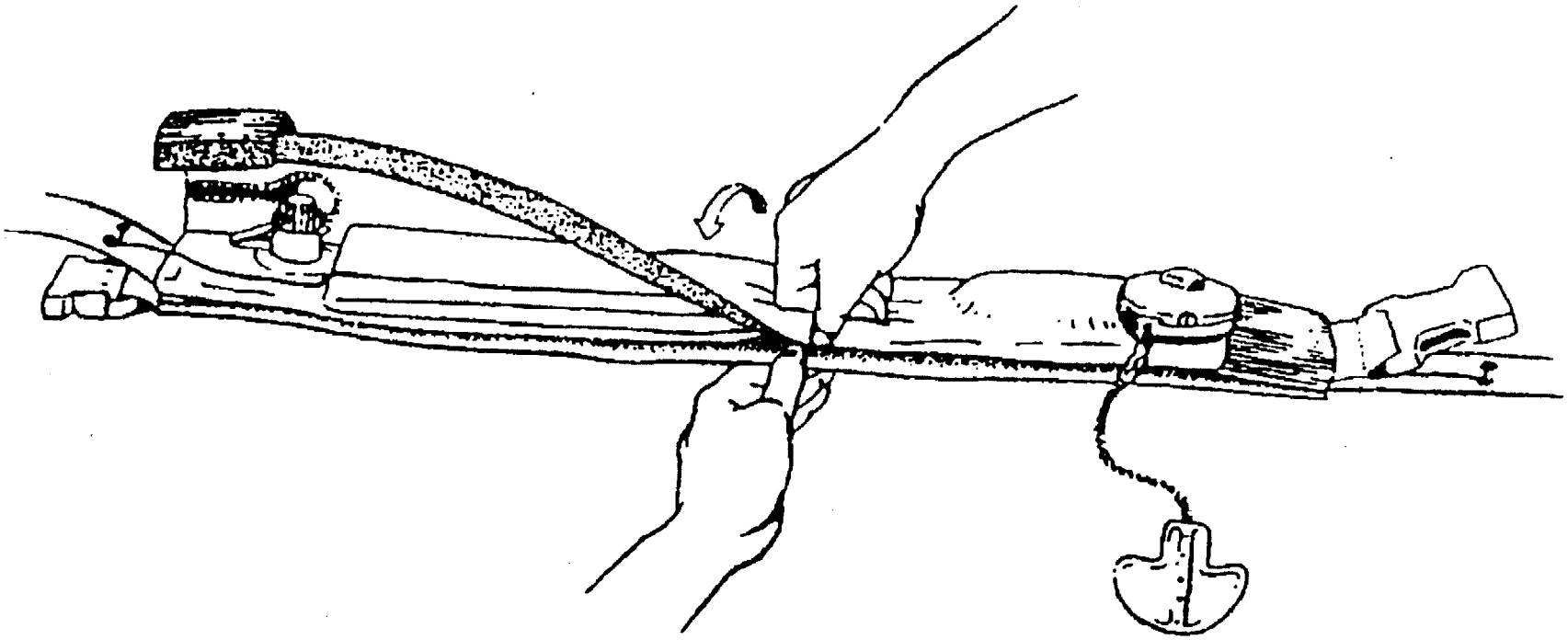
Figure 25:
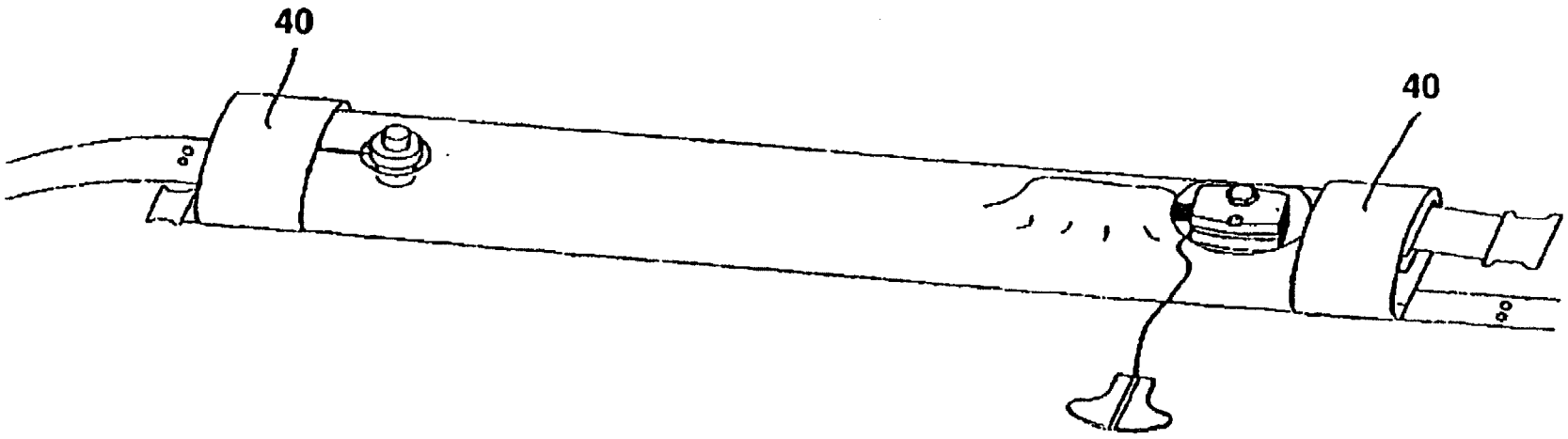

FIGS. 20–25 are helpful in understanding how to pack the inflatable swimmer's safety belt after use. In FIG. 20, a finger pressing down in the oral inflator 60 deflates its valve (FIG. 20*a*), and the inflatable belt 36 is then rolled to achieve complete deflating. The Inflatable belt is then folded in half (FIG. 21*a*), and then in half once again (FIG. 21*b*), along provided memory folds to assist in the packing. The belt is then formed in a Z-fold 79 (FIG. 22), so that the elbow 81 of the fold just touches the oral inflator/deflator 60. The inflatable belt of FIG. 22 is then set down on top of the "jacket belt" so that the 2 hole openings 45, 47 in the jacket belt line up exactly with the compressed gas inflator 61 and oral inflator/deflator 60. Where the oral inflator 60 does not exactly line up with the opening 45, the Z-fold 79 is simply adjusted inside the jacket belt by pulling its lower arm to the right(FIG. 23). With the tether 55 inside the jacket belt parallel and next to the Z-fold 79 (See FIG. 23) the jacket belt is then closed by pulling the two Velcro strips 42, or similar adhesive securements together. (FIG. 24*a*, 24*b*). When done correctly, the closed belts will take on the appearance of FIG. 25, with the Velcro or other strip 40 closing off the ends. A smooth, streamlined packing results in the appearance of FIG. 25, with tight bindings around the ends. In such way, and with the streamlining which results, the packed swimmer's safety belt can be attractively worn around to the front of the wearer's waist, without any degree of bulkiness or lumpiness in appearance. With the invention at hand, the inflatable swimmer's safety belt can be worn all day long, both on land or on a boat, in the "ready position". Once in the water, all the wearer has to do is to pull on the lanyard, and the belt automatically inflates into the life preserver position of FIG. 7, or the life vest position as in FIG. 19. Field testing has confirmed that with the snap-hook and ring coupling maintained, the configuration of the life preserver tube, and inherent buoyant life vest results, to keep an unconscious swimmer afloat and a tiring swimmer afloat, by forcing his or her head back out of the water, especially where even increased buoyancy is provided through compressed gas cartridge selection.

While there has been described what is considered to be a preferred embodiment of the present invention, it will be readily appreciated by those skilled in the art that modifications can be made without departing from the scope of the teachings herein. For at least such reasons, therefore, resort should be had to the claims appended hereto for a complete understanding of the inflatable swimmer's safety belt of the invention, which inflates into a life preserver for maximum freedom, or snaps into a life vest for maximum security.

I claim:

1. An inflatable swimmer's safety belt, life preserver/life vest comprising:

a first, substantially hollow belt, closable to fit the waist of a wearer;

a compressed gas cartridge coupled with said first belt;

a pin, moveable to puncture said cartridge so as to allow said cartridge to fill said first belt with compressed gas;

means, moveable between first and second positions, and connected to said pin, for moving said pin to puncture said cartridge when moved to said second position;

wherein a portion of said first belt fitting the waist of a wearer is temporarily secured in folded, overlapping relationship so as to unfold and expand outwardly under action of the compressed gas which fills it when said means is moved to said second position to puncture said cartridge, thereby inflating said first belt and increasing the length of said first belt in forming a tube to ride upwardly towards the arm level of the wearer;

a second belt, underlying said first belt, and also closable to fit about the waist of a wearer;

wherein each of said first and said second belts are closable by clasps to fit the waist of a wearer;

a tether connected between said first and said second belts;

and wherein means are provided on said first belt for maintaining the configuration of said tube formed by inflating said first belt, even when said clasp of said first belt is thereafter opened;

and wherein said last mentioned means include releasable couplings respectively provided adjacent opposite ends of said first belt.

2. The inflatable swimmer's safety belt, life preserver/life vest of claim 1, wherein said tether is of a length to restrict the upward riding of said tube formed by inflating said first belt to a predetermined amount.

3. The inflatable swimmer's safety belt, life preserver/life vest of claim 1, wherein said tether is connected between an underside surface of said first belt and a topside surface of said second belt.

4. The inflatable swimmer's safety belt, life preserver/life vest of claim 1, wherein said tether is of a length to restrict the upward riding of said tube formed by inflating said first belt to substantially the neck of a wearer.

5. The inflatable swimmer's safety belt, life preserver/life vest of claim 1, wherein said first belt, once said clasp of said first belt is thereafter opened, is of a length to couple about said second belt, and to connect thereto by then closing of said clasp of said first belt.

6. The inflatable swimmer's safety belt, life preserver/life vest of claim 1, also including a jacket enclosing said first and second belts about the waist of a wearer.

7. The inflatable swimmer's safety belt, life preserver/life vest of claim 6, wherein said jacket encloses at least said portion of said first belt of folded, overlapping relationship.

8. The inflatable swimmer's safety belt, life preserver/life vest of claim 7, wherein said last mentioned means include snap-hook and ring-couplings at opposite ends of said jacket enclosing said first belt about the,waist of a wearer.

9. The inflatable swimmer's safety belt, life preserver/life vest of claim 8, wherein said jacket is adhesively secured to release said first belt when said first belt fills with said compressed gas during the inflation thereof.

10. The inflatable swimmer's safety belt, life preserver/life vest of claim 9, wherein said compressed gas cartridge is positioned on said first belt.

11. The inflatable swimmer's safety belt, life preserver/life vest of claim 8, Wherein said jacket encloses at least said portion of said first belt in an overlapping Z-fold.

12. The inflatable swimmer's safety belt, life preserver/life vest of claim 8, wherein said jacket encloses at least said portion of said first belt in an overlapping Z-fold of rectangular configuration.

13. The inflatable swimmer's safety belt, life preserver/life vest of claim 1, also including means cooperating with said first belt to allow the filling thereof by wearer's breath.

14. The inflatable swimmer's safety belt, life preserver/life vest of claim 1, wherein said compressed gas cartridge is removeably coupled with said first belt for replacement after use.

15. The inflatable swimmer's safety belt, life preserver/life vest of claim 1, wherein said portion of said first belt in overlapping relationship unfolds under action of the compressed gas which fills it to increase the length of the belt of the order of 10 inches.

16. The inflatable swimmer's safety belt, life preserver/life vest of claim 1, wherein said cartridge is filled with a compressed gas of buoyancy to cause said first belt to float in a water environment.

17. The inflatable swimmer's safety belt, life preserver/life vest of claim 1, wherein said first belt is constructed of a nylon, polyurethane—coated composition.

18. The inflatable swimmer's safety belt, life preserver/life vest of claim 1, wherein said compressed gas cartridge is of 16 gram capacity.

19. The inflatable swimmer's safety belt, life preserver/life vest of claim 1, wherein said compressed gas cartridge is of 25 gram capacity.

* * * * *